US009157185B2

(12) United States Patent
Inoue et al.

(10) Patent No.: US 9,157,185 B2
(45) Date of Patent: Oct. 13, 2015

(54) WET PAPER WEB TRANSFER BELT, PAPERMAKING SYSTEM AND PAPERMAKING METHOD

(71) Applicant: Ichikawa Co., Ltd., Bunkyo-ku (JP)

(72) Inventors: Kenji Inoue, Tokyo (JP); Masatoshi Kono, Tokyo (JP); Ryo Umehara, Tokyo (JP); Ai Tamura, Tokyo (JP); Toshihiro Tsuji, Tokyo (JP)

(73) Assignee: ICHIKAWA CO., LTD., Bunkyo-ku (JP)

( * ) Notice: Subject to any disclaimer, the term of this patent is extended or adjusted under 35 U.S.C. 154(b) by 0 days.

(21) Appl. No.: 14/033,009

(22) Filed: Sep. 20, 2013

(65) Prior Publication Data

US 2014/0076511 A1 Mar. 20, 2014

(30) Foreign Application Priority Data

Sep. 20, 2012 (JP) ..... 2012-206802

(51) Int. Cl.
*D21F 2/00* (2006.01)
*D21F 1/66* (2006.01)
(Continued)

(52) U.S. Cl.
CPC .. *D21F 7/08* (2013.01); *D21F 1/66* (2013.01); *D21F 2/00* (2013.01); *D21F 3/029* (2013.01); *D21F 7/086* (2013.01)

(58) Field of Classification Search
CPC ... D21F 1/0027; D21F 1/0036; D21F 1/0054; D21F 1/0063; D21F 1/10; D21F 1/105; D21F 2/00; D21F 3/02; D21F 3/029; D21F 3/04; D21F 7/08; D21F 7/083; D21F 7/086; D21F 7/10; D21F 7/12; D21F 1/66
USPC ..... 162/306, 358.1, 358.2, 358.4, 348, 361, 162/362, 900–904
See application file for complete search history.

(56) References Cited

U.S. PATENT DOCUMENTS 3,652,390 A * 3/1972 Peterson ..... 162/303
3,867,766 A * 2/1975 Wagner ..... 34/95
(Continued)

FOREIGN PATENT DOCUMENTS

EP 0 576 115 A1 12/1993
EP 1 770 205 A2 4/2007
(Continued)

OTHER PUBLICATIONS

JP 2012-097365, May 2012, English language machine translation, http://www4.ipdl.inpit.go.jp/Tokujitu/PAJdetail.ipdl?N0000=60&N0120=01&N2001=2&N3001=2012-097365.*
(Continued)

*Primary Examiner* — Eric Hug
(74) *Attorney, Agent, or Firm* — Oblon, McClelland, Maier & Neustadt, L.L.P.

(57) ABSTRACT

A wet paper web transfer belt for transferring a wet paper web includes a wet paper web contacting surface for carrying the wet paper web. The wet paper web contacting surface is constituted by a resin layer. The wet paper web contacting surface includes, in the width direction, sheet edge regions for carrying the edge parts of the wet paper web and a center region for carrying the center vicinity of the wet paper web. The arithmetic average roughness $Ra_1$ (μm) of the wet paper web contacting surface in the sheet edge regions is smaller than the arithmetic average roughness $Ra_2$ (μm) of the wet paper web contacting surface in the center region, and prescribed roughness related equations are fulfilled.

14 Claims, 10 Drawing Sheets

(51) Int. Cl.
*D21F 7/08* (2006.01)
*D21F 3/02* (2006.01)

(56) References Cited

U.S. PATENT DOCUMENTS

| | | | | |
|---|---|---|---|---|
| 5,298,124 | A * | 3/1994 | Eklund et al. | 162/306 |
| 5,397,438 | A * | 3/1995 | Nyberg et al. | 162/207 |
| 7,811,418 | B2 * | 10/2010 | Klerelid et al. | 162/358.2 |
| 8,241,464 | B2 * | 8/2012 | Pilsbury et al. | 162/348 |
| 2004/0020549 | A1 * | 2/2004 | Augscheller et al. | 139/383 A |
| 2007/0074836 | A1 * | 4/2007 | Westerkamp | 162/193 |
| 2007/0169909 | A1 * | 7/2007 | Westerkamp et al. | 162/358.2 |
| 2011/0127000 | A1 * | 6/2011 | Yazaki et al. | 162/289 |

FOREIGN PATENT DOCUMENTS

| | | | |
|---|---|---|---|
| EP | 1 770 205 | A3 | 4/2007 |
| EP | 1 813 715 | A1 | 8/2007 |
| JP | 06-57678 | A | 3/1994 |
| JP | 2011-162911 | A | 8/2011 |
| JP | 2012-097365 | A | 5/2012 |

OTHER PUBLICATIONS

Extended European Search Report issued Oct. 29, 2013, in European Patent Application No. 13185111.5.
U.S. Appl. No. 14/032,783, filed Sep. 20, 2013, Inoue et al.
U.S. Appl. No. 14/608,629, filed Jan. 29, 2015, Inoue et al.
U.S. Appl. No. 14/608,660, filed Jan. 29, 2015, Inoue et al.

* cited by examiner

WET PAPER WEB TRANSFER BELT, PAPERMAKING SYSTEM AND PAPERMAKING METHOD

TECHNICAL FIELD

The instant application relates to a wet paper web transfer belt used in a papermaking machine, a papermaking system and a papermaking method.

BACKGROUND ART

Papermaking machines for removing moisture from the source material of paper are generally equipped with a wire part, a press part and a dryer part. These parts are arranged in the order of wire part, press part and dryer part in the wet paper web transfer direction.

In one type of papermaking machine, the wet paper web is passed from one part to another in an open-draw. In the press part of this open-draw papermaking machine, there are a number of places in which the wet paper web is not supported by any roll or by papermaking equipment such as a felt or a belt; in other words, places in which the wet paper web is traveling on its own. In these places, problems such as "web breaks" tend to occur. The risk of these problems occurring increases as the papermaking machine is operated at higher speeds. Therefore, there are limitations to operating an open-draw papermaking machine at high speeds.

In recent years, most papermaking machines have been of the type in which the wet paper web is passed in a closed-draw. In the press part of this closed-draw papermaking machine, the wet paper web is transferred while being placed on a papermaking felt or wet paper web transfer belt, the wet paper web being passed between the belt and the felt. Therefore, there are no places in which the wet paper web travels on its own as in the open-draw papermaking machine. As a result, it is possible to operate papermaking machines at even higher speeds and to stabilize operations.

Incidentally, in the press part of such a closed-draw papermaking machine, the so-called "paper robbing" phenomenon may occur, in which the wet paper web gets stuck at a belt or a felt when it is passed between the belts or felts and is not passed to the next belt or felt to which it ought to be passed; or the so-called "floating edges" (damp edges) phenomenon may occur, in which the edge parts of the wet paper web are released from the belt or felt and end up floating freely. In conventional machines, when the "paper robbing" phenomenon occurs, it is necessary to temporarily stop the papermaking operation and to change the setting of the device so that the wet paper web is properly passed. When the "floating edges" phenomenon occurs, there is the possibility that quality problems occur such as wrinkles in the wet paper web, that the web breaks (sheet break) problem occurs, or that operational problems occur, such as the need to reduce the operating speed of the papermaking machine so that web breaks (or the floating edges problem) do not occur.

A number of studies have been made for improving the wet paper web transfer properties in the press part.

JP 06-057678 teaches a wet paper web transfer belt, in which a wet paper web contacting surface formed on the upper surface of a base (wet paper web side) is formed by an impermeable polymer coating layer and a lower surface of the base (roll side) is formed by a fibrous web. Particles with a higher hardness than the polymer coating are mixed in the impermeable polymer coating layer and the particles are made to protrude from the surface by such means as polishing the wet paper web contacting surface.

Moreover, the wet paper web contacting surface is a rough surface configured to be in the range of Rz=0 microns to 20 microns inside the press part and to recover to within the range of Rz=2 microns to 80 microns after exiting the press part.

The wet paper web transfer belt according to JP 06-057678 realizes to a high degree the adhesive and release properties of the wet paper web with the wet paper web contacting surface required to wet paper web transfer belts. Nevertheless, the prevention of the "floating edges" phenomenon is not an object of the belt according to JP 06-057678. Moreover, since different types of paper are made in the papermaking step, the basis weight of the paper naturally also differs. Therefore, the amount of moisture removed from the wet paper web during the pressing and the moisture content and amount of moisture of the wet paper web after pressing also differ. The moisture of the wet paper web after pressing has a big influence on the adhesive and release properties of the wet paper web in relation to the wet paper web contacting surface of the wet paper web transfer belt; from this point of view, the wet paper web transfer belt according to JP 06-057678 is not adequate for realizing the adhesive and release properties of the wet paper web for different types of paper (in particular paper of different basis weight).

JP 2012-97365 discloses a papermaking felt comprising a base fabric and a batt fiber layer for forming a papermaking surface. The batt fiber layer is entangled with the base fabric by needling. The papermaking surface comprises a polished surface polished under different conditions in each part in the width direction. The surface roughness of the parts corresponding to both edges of the wet paper web (edge corresponding parts) in the width direction is smaller than the surface roughness of the center part. By using this constitution, the wet paper web adhesiveness of the papermaking felt is greater in the parts corresponding to both edges of the wet paper web than in its center part, and the "floating edges" phenomenon is prevented. Nevertheless, JP 2012-97365 does not disclose a wet paper web transfer belt and the constitution thereof, for carrying a wet paper web on a resin layer in which the surface roughness differs greatly.

Furthermore, US 2007/0074836 discloses a wet paper web transfer belt, characterized in that one of the alternative characteristics of wet paper web transfer belts such as surface roughness, bending strength, compressibility, recovery capacity can be continuously changed in the width direction of the wet paper web transfer belt in order to correspond to the papermaking machine specific profile.

SUMMARY

Therefore, an object of the instant application is to provide a wet paper web transfer belt having excellent wet paper web transfer properties wherein such phenomena as "paper robbing" and "floating edges" are simultaneously prevented.

Moreover, another object of the instant application is to provide a wet paper web transfer belt wherein the above-mentioned wet paper web transfer properties are realized for the different types of paper (in particular base paper of different basis weight) made in the papermaking step.

Another object of the instant application is to provide a papermaking system having excellent production stability, which is equipped with such a wet paper web transfer belt, and a papermaking method having excellent production stability, which uses a wet paper web transfer belt.

In their studies for solving the above-mentioned problems, the inventors of the instant application have found that, in a wet paper web transfer belt, the surface state of the resin layer surface contacting the wet paper web, (in other words the wet paper web contacting surface), has a big influence on improving the wet paper web transfer properties.

Then they found that by using different surface conditions in the center region vicinity of the wet paper web contacting surface and the edge regions contacting the edge parts of the wet paper web, the adhesive and release properties of the entire wet paper web with the wet paper web transfer belt are adjusted to a suitable degree, while the adhesiveness of the edge parts of the wet paper web with the wet paper web transfer belt is sufficient.

The inventors further found that, as far as the surface state of the wet paper web contacting surface of the wet paper web transfer belt is concerned, not only the surface roughness, but also the swelling rate of the resin layer constituting the wet paper web side surface with water has an influence on the adhesive and release properties of the wet paper web with the wet paper web transfer belt. It was also found that the surface state of the wet paper web contacting surface of a suitable wet paper web transfer belt can be changed according to the type of wet paper web (in particular base paper of different basis weight).

Namely, the instant application is based on the following technology:

A wet paper web transfer belt for transferring a wet paper web including a wet paper web contacting surface for carrying the wet paper web. The wet paper web contacting surface is made of a resin layer. The wet paper web contacting surface includes, in the width direction, sheet edge regions for carrying the edge parts of the wet paper web and a center region for carrying the center vicinity of the wet paper web. The arithmetic average roughness $Ra_1$ (μm) of the wet paper web contacting surface in the sheet edge regions is smaller than the arithmetic average roughness $Ra_2$ (μm) of the wet paper web contacting surface in the center region, and the relations of equations (1) and (2) shown hereinafter are fulfilled.

$$Ra_2(\mu m)=0.0125\times X+A \quad (1)$$

$$A\leq B\times 10^{-16}\times Y^4+C\times 10^{-4}\times Y^3+D\times 10^{-2}\times Y^2+E\times Y+F \quad (2),$$

where:

X=basis weight (g/m$^2$) of the base paper to be produced from the wet paper web to be transferred, Y=swelling rate (%) of the resin constituting the resin layer with water,

B=4.441,

C=9.132,

D=−4.247,

E=0.6580,

F=3.1027, and respectively.

Advantages of the Instant Application

By adopting the above constitution, it is possible to provide a wet paper web transfer belt having excellent wet paper web transfer properties wherein the "paper robbing" and "floating edges" phenomena are simultaneously suppressed.

In particular, by setting the surface state of the wet paper web contacting surface in consideration of the basis weight of the wet paper web to be transferred and the swelling rate of the resin layer constituting the wet paper web contacting surface with water, it is possible to provide a wet paper web transfer belt, wherein the above-described wet paper web transfer properties, corresponding to different types of paper (in particular paper of different basis weight) of the papermaking step, are realized.

Moreover, it is possible to provide a papermaking system having excellent production stability equipped with such a wet paper web transfer belt and a papermaking method having excellent production stability using the wet paper web transfer belt.

DESCRIPTION OF EMBODIMENTS

Figure 1:
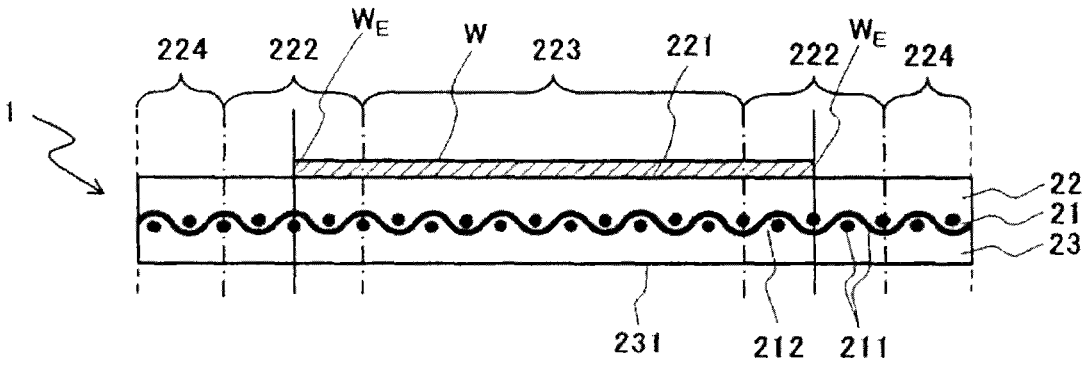
FIG. 1 is a cross-sectional view showing one example of a wet paper web transfer belt according to a preferred embodiment.

Hereinafter preferred embodiments of the wet paper web transfer belt, papermaking system and papermaking method according to the present invention will be described in detail by referring to the drawings.

Figure 2:
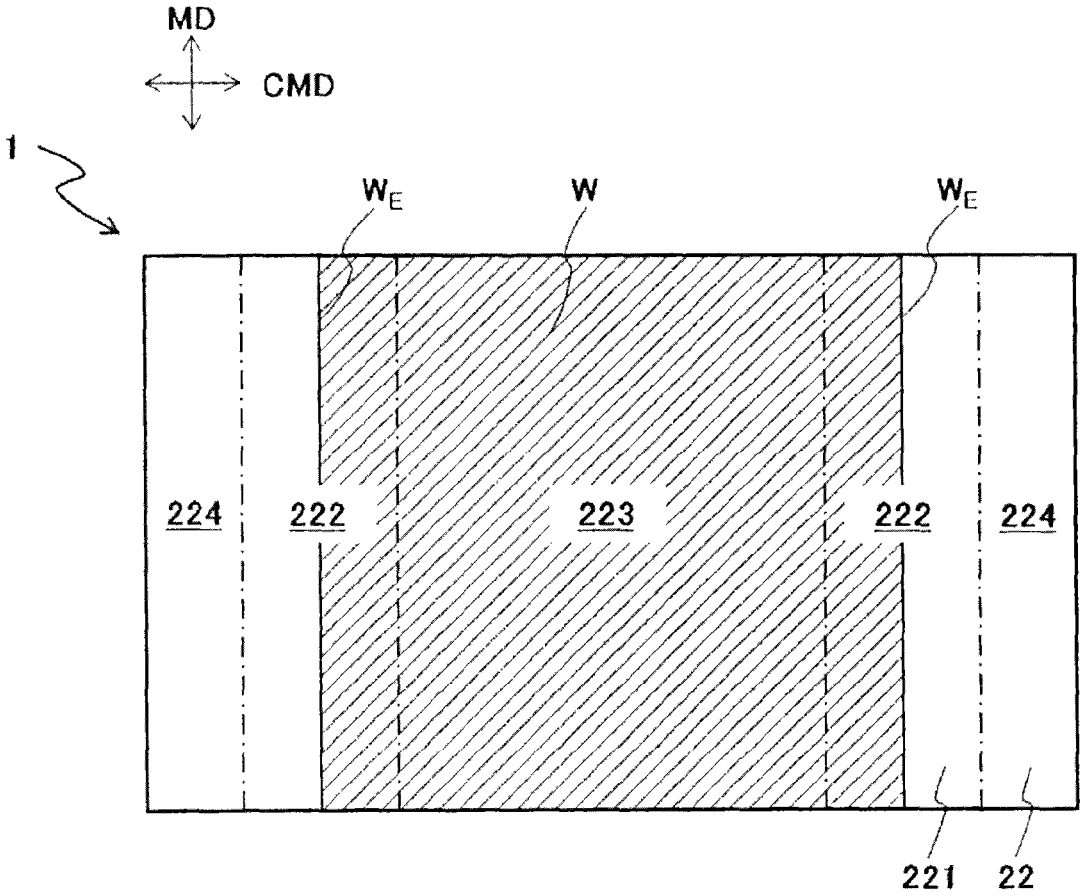
FIG. 2 is a plan view showing one example of a wet paper web transfer belt according to a preferred embodiment.

Firstly, a wet paper web transfer belt will be described. FIG. 1 is a cross-sectional view showing one example of a wet paper web transfer belt according to a preferred embodiment, and FIG. 2 is a plan view showing one example of a wet paper web transfer belt according to a preferred embodiment. It should be noted that, in FIGS. 1 and 2, a wet paper web W to be transferred is shown to facilitate understanding; however, it goes without saying that this is not the constitution of wet paper web transfer belt 1. Moreover, in the drawings, "MD" indicates the planned machine direction in the papermaking system and "CMD" indicates the planned cross machine direction in the papermaking system.

The wet paper web transfer belt according to the instant application is a wet paper web transfer belt for transferring a wet paper web, comprising a wet paper web contacting surface for carrying the wet paper web. The wet paper web contacting surface is made of a resin layer. The wet paper web contacting surface comprises, in the width direction, sheet edge regions for carrying the edge parts of the wet paper web and a center region for carrying the center vicinity of the wet paper web. The arithmetic average roughness $Ra_1$ (μm) of the wet paper web contacting surface in the sheet edge regions is smaller than the arithmetic average roughness $Ra_2$ (μm) of the wet paper web contacting surface in the center region, and the relations of equations (1) and (2), which are discussed hereinafter, are fulfilled.

The wet paper web transfer belt 1 shown in FIGS. 1 and 2 is used for the transfer and passing of the wet paper web W in the press part of a papermaking machine. The wet paper web transfer belt 1 forms an endless band-shaped body. In other words, the wet paper web transfer belt 1 is an annular belt. Moreover, the longitudinal direction of the wet paper web transfer belt 1 is generally disposed along the machine direction (MD) of a papermaking system.

The wet paper web transfer belt 1 comprises a reinforcing fibrous substrate layer 21, a 1$^{st}$ resin layer (wet paper web contacting resin layer) 22 provided on one surface of the reinforcing fibrous substrate layer 21, and a 2$^{nd}$ resin layer (roll-side layer) 23 provided on the other surface of the reinforcing fibrous substrate layer 21; these layers are formed by laminating. Moreover, the 1$^{st}$ resin layer is the layer that forms the outer surface of the annular shape forming the wet paper web transfer belt 1.

The reinforcing fibrous substrate layer 21 is made of a reinforcing fibrous substrate 211, and a resin 212. The resin 212 is present in the reinforcing fibrous substrate layer 21 so as to fill the gaps of the fibers in the reinforcing fibrous substrate 211.

There are no particular limitations with regard to the reinforcing fibrous substrate 211, however, for example, fabrics woven by a weaving machine and the like from warp and weft yarns are commonly used. Moreover, it is also possible to use a grid-like web material of superimposed rows of warp and weft yarns without weaving.

The fineness of the fibers constituting the reinforcing fibrous substrate 211 is not particularly limited, for example, 300 to 10000 dtex, and preferably 500 to 6000 dtex may be used.

Moreover, the fineness of the fibers constituting the reinforcing fibrous substrate 211 may be different depending on the part in which the fibers are used. For example, the fineness of the warp and weft yarns in the reinforcing fibrous substrate 211 may be different.

As the reinforcing fibrous substrate 211, it is possible to use one or a combination of two or more of polyesters (polyethylene terephthalate, polybutylene terephthalate, and the like), aliphatic polyamides (polyamide 6, polyamide 11, polyamide 12, polyamide 612, and the like), aromatic polyamides (aramid), polyvinylidene fluoride, polypropylene, polyether ether ketone, polytetrafluoroethylene, polyethylene, wool, cotton, metals, and the like.

As the resin 212, it is possible to use one or a combination of two or more of thermosetting resins such as urethane, epoxy, acryl and the like, or thermoplastic resins such as polyamide, polyarylate, polyester, and the like. Preferably, urethane resin can be used.

The urethane resin used in the resin 212 is not particularly limited; however, for example, urethane resin obtained by curing a urethane prepolymer having a terminal isocyanate group obtained by reacting an aromatic or aliphatic polyisocyanate compound and polyol with a curing agent having an active hydrogen group may be used. Moreover, it is possible to use an anionic, nonionic or cationic aqueous urethane resin of the forced emulsification type or self-emulsification type. In this case, for improving the resistance to water, it is also possible to crosslink the aqueous urethane resin by using a cross linking agent of melamine, epoxy, isocyanate, carbodiimide and the like together with the aqueous urethane resin.

Moreover, the resin 212 may also comprise one type or a combination of two or more types of inorganic fillers such as titanium oxide, kaolin, clay, talc, diatomaceous earth, calcium carbonate, calcium silicate, magnesium silicate, silica, mica, and the like.

Further, the type and composition of the resin 212 in the reinforcing fibrous substrate layer 21 may be different in each part of the reinforcing fibrous substrate layer 21, or it may be the same.

The 1$^{st}$ resin layer 22 is provided on one surface of the reinforcing fibrous substrate layer 21 and is mainly made of a resin material (resin). The 1$^{st}$ resin layer 22 constitutes a wet paper web contacting surface 221, which is in contact with the wet paper web W and carries the wet paper web W at the opposite side of the surface that is joined to the reinforcing fibrous substrate layer 21. In other words, the wet paper web transfer belt 1 carries the wet paper web W on the wet paper web contacting surface 221 of the 1$^{st}$ resin layer 22 and can transfer the wet paper web W.

As shown in FIG. 2, the wet paper web contacting surface 221 comprises, in the width direction, 2 sheet edge regions 222 for carrying the edge part of the wet paper web W, a center region 223 for carrying the center vicinity of the wet paper web W, positioned at the inner side of the 2 sheet edge regions 222, and 2 border regions 224, which are the edge parts' vicinity of the wet paper web contacting surface 221, positioned at the outer side of the 2 sheet edge regions 222. Moreover, the sheet edge regions 222, the center region 223, and the border regions 224, respectively, extend in the longitudinal direction (machine direction) of the wet paper web transfer belt 1.

In the instant application, the arithmetic average roughness $Ra_1$ (μm) of the wet paper web contacting surface 221 in the sheet edge regions 222 is smaller than the arithmetic average roughness $Ra_2$ (μm) of the wet paper web contacting surface 221 in the center region 223. As just described, by using a relatively small surface roughness for the wet paper web contacting surface 221 in the sheet edge regions 222, it is possible to obtain a high adhesiveness of the wet paper web contacting surface with the wet paper web in the sheet edge regions 222. The result thereof is that the edge parts of the wet paper web W are not easily released from the wet paper web contacting surface 221 when the wet paper web W is passed from a felt to the wet paper web transfer belt 1 and even when it passes the nip, and that the "floating edges" phenomenon is prevented. On the other hand, by using a suitable degree of surface roughness of the wet paper web contacting surface 221 in the center region 223, the wet paper web W adheres sufficiently to the wet paper web contacting surface 221 of the wet paper web transfer belt 1 and is reliably passed when the wet paper web W is passed from the felt to the wet paper web transfer belt 1 in the press part, and the wet paper web W is easily released from the wet paper web contacting surface 221 of the wet paper web transfer belt 1 and is reliably passed when it is passed from the wet paper web transfer belt 1 to the dryer fabric. Thus, in the instant application, by using a different surface roughness in the sheet edge regions 222 and the center region 223 of the wet paper web contacting surface 221, it is possible to simultaneously suppress the "paper robbing" and the "floating edges" phenomenon, and to obtain excellent wet paper web transfer properties of the wet paper web transfer belt 1.

Moreover, in the instant application, surface roughness (arithmetic average surface roughness Ra) means the arithmetic average roughness Ra defined in JIS B0601.

Moreover, the arithmetic average roughness $Ra_2$ (μm) of the wet paper web contacting surface 221 in the center region 223 simultaneously fulfills the relations of equations (1) and (2) hereinafter.

$$Ra_2(\mu m)=0.0125\times X+A \quad (1)$$

$$A\leq B\times 10^{-16}\times Y^4+C\times 10^{-4}\times Y^3+D\times 10^{-2}\times Y^2+E\times Y+F \quad (2),$$

(wherein the symbols are: X=basis weight (g/m$^2$) of the base paper to be produced from the wet paper web to be transferred, Y=swelling rate (%) of the resin constituting the resin layer with water, B=4.441, C=9.132, D=−4.247, E=0.6580, F=3.1027, respectively).

By simultaneously fulfilling the relations of the above equations (1) and (2), the wet paper web adheres sufficiently to the wet paper web contacting surface 221 of the wet paper web transfer belt 1 and is reliably passed when the wet paper web W is passed from the felt to the wet paper web transfer belt 1.

As just described, the adhesiveness between the wet paper web W and the wet paper web contacting surface 221 varies not only depending on the surface roughness of the wet paper web contacting surface 221, but also depending on the swelling rate of the resin constituting the resin layer with water. Moreover, the surface state required of the wet paper web contacting surface 221 of the wet paper web transfer belt 1 differs depending on the base paper basis weight of the wet paper web W passing the press part. The inventors of the present invention found the facts as described above and found the relation of the equations (1) and (2) for the wet paper web transfer belt 1 to have excellent wet paper web transfer properties for different types of paper.

Moreover, the arithmetic average surface roughness $Ra_2$ (μm) of the wet paper web contacting surface 221 in the center region 223 is not particularly limited as long as the relations described above are fulfilled. However, it is preferred to simultaneously fulfill the relations of the equation (1) above and the equation (3) hereinafter.

$$B\times 10^{-16}\times Y^4+C\times 10^{-4}\times Y^3+D\times 10^{-2}\times Y^2+E\times Y+G\leq A \quad (3),$$

(wherein Y and A to E are the same as above and G=0.6027).

By simultaneously fulfilling the relations of the above equations (1) and (3), the wet paper web W is easily released from the wet paper web contacting surface 221 of the wet paper web transfer belt 1 and is more reliably passed when the wet paper web W is passed from the wet paper web transfer belt 1 to the dryer fabric or the like.

Further, examples of the range of the constant A corresponding to the respective example of the swelling rate Y (%) are shown in Table 1.

TABLE 1

| Examples of swelling rate Y (%) of the resin | Range of constant A (equation (3) left side ≤ A ≤ (2) right side) |
|---|---|
| 1.5 | 1.50 ≤ A ≤ 4.00 |
| 3.0 | 2.22 ≤ A ≤ 4.72 |
| 5.0 | 2.95 ≤ A ≤ 5.45 |
| 7.5 | 3.53 ≤ A ≤ 6.03 |
| 10.0 | 3.85 ≤ A ≤ 6.35 |
| 15.0 | 4.00 ≤ A ≤ 6.50 |

In the present specification, the swelling rate (%) of the resin with water represents the weight change rate of the resin weight before it is immersed in warm water of 40° C. for 30 hours and after it was immersed in warm water of 40° C. for 30 hours and can be defined by the equation hereinafter.

Swelling rate(%)=(resin weight after swelling with water−resin weight before swelling with water)/(resin weight before swelling with water)×100 (%)

Further, the swelling rate of the resin was measured after moisture control by exposing the resin prior to immersion to an environment of a temperature of 20° C. and a relative humidity of 60%.

Moreover, in the present invention, the basis weight means the basis weight of paper measured according to JIS P 8124: 2011 after moisture control.

The arithmetic average roughness $Ra_1$ (μm) of the wet paper web contacting surface 221 in the sheet edge regions 222 is not particularly limited as long as it fulfills the above-mentioned relations, however, it is preferably 3.5 μm or less, and even more preferably 3.0 or less. By this means, the adhesiveness between the edge parts of the wet paper web and the wet paper web contacting surface 221 in the sheet edge regions 222 is sufficiently high and the "floating edges" phenomenon is prevented with greater reliability.

Moreover, it is preferred that the above-mentioned wet paper web contacting surface roughness $Ra_1$ and the above-mentioned wet paper web surface roughness $Ra_2$ fulfill equation (4) hereinafter.

$$(Ra_2-Ra_1)\geq 0.3(\mu m) \quad (4)$$

By this means, the effect of a difference in the sheet transfer properties (sheet adhesive force and release force) is obtained.

Moreover, $Ra_1$ and $Ra_2$ may be the roughness of a new wet paper web transfer belt 1 before it is installed in a papermaking machine, or it may be the roughness of a used wet paper web transfer belt 1 after it has been installed in a papermaking machine. As a result of this, the wet paper web transfer belt 1 can be used in a stable manner.

Moreover, the width of the sheet edge regions 222 and the width of the center region 223 are not particularly limited, as they can be suitably adjusted depending on the width of the wet paper web to be transferred and the transfer method. For example, the width of the sheet edge regions 222 may each be 0.1 to 20%, preferably 0.5 to 15%, and particularly preferably 1.0 to 10%, of the width of the wet paper web. In consideration of a displacement in the width direction during the transfer of the wet paper web, the width of the sheet edge regions 222 may be slightly on the large side. Moreover, the sheet edge regions 222 may be arranged so that the edge parts (the planned edge parts) of the wet paper web to be transferred are arranged on the center line (edge parts $W_E$) of the sheet edge regions 222.

Moreover, the width of the center region 223 may be set so that 80 to 99.9%, preferably 85 to 99.5%, and more preferably 90 to 99.0% of the width of the wet paper web are transferred in the center region 223. Further, the center region 223 may be arranged so that the center line of the center region 223 matches the center line (planned center line) of the wet paper web to be transferred.

Moreover, the width of the sheet edge regions 222 may each be 1 to 20 cm, and preferably 5 to 15 cm, with the edge parts $W_E$ (planned edge parts) of the wet paper web to be transferred as its center lines. Further, the region at the inner side of the 2 sheet edge regions 222 may be made the center region 223. By this means, it is possible to deal with dimensional variations of the wet paper web transfer belt 1 during use, sheet width adjustments and the like.

Moreover, the border regions 224 are provided at the outer side of the sheet edge regions 222. The width of the border regions 224 and the surface roughness of the wet paper web contacting surface 221 in the border regions 224 are not particularly limited.

As resin material constituting the $1^{st}$ resin layer 22, it is possible to use one type or a combination of two or more types of the resin materials that can be used in the reinforcing fibrous substrate layer 21, as described above. The type and composition of the resin material constituting the $1^{st}$ resin layer 22 and the resin constituting the reinforcing fibrous substrate layer 21 may be the same or may be different.

From the point of view of mechanical strength, wear resistance and flexibility, in particular urethane resins are preferred as resin material constituting the $1^{st}$ resin layer 22. Moreover, the $1^{st}$ resin layer 22 may also comprise one or more inorganic fillers in the same way as the reinforcing fibrous substrate layer 21.

Further, the type and composition of the resin materials and the inorganic fillers in the $1^{st}$ resin layer 22 may be different in each part of the $1^{st}$ resin layer 22 or it may be the same. For example, the type and composition of the resin material and the inorganic filler constituting the $1^{st}$ resin layer 22 in the sheet edge regions 222, the center region 223 and the border regions 224 may be different or may be identical. For example, the type and/or amount of inorganic filler in the $1^{st}$ resin layer 22 may be different in the sheet edge regions 222, the center region 223, and the border regions 224, respectively. By using different compositions in the parts corresponding to each region, it is possible to change the surface roughness and swelling rate Y of the wet paper web contacting surface 221 in each region.

Moreover, it is preferred that the $1^{st}$ resin layer 22 has the property of not letting water pass. In other words, it is preferred that the $1^{st}$ resin layer 22 is impermeable to water. In the instant application, "water impermeability" means that the water impermeable body does not have pores with a pore size sufficient to let water pass.

The $2^{nd}$ resin layer (roll-side layer) 23 is provided on one surface of the reinforcing fibrous substrate layer 21 and is mainly made of a resin material. The $2^{nd}$ resin layer 23 constitutes a roll contacting surface 231 for contacting a roll, described hereinafter, at the opposite side of the surface that is joined to the reinforcing fibrous substrate layer 21. For transferring the wet paper web, the wet paper web transfer belt 1 can be powered during use via a roll by bringing the roll contacting surface 231 in contact with a roll.

As resin material constituting the $2^{nd}$ resin layer 23, it is possible to use one type or a combination of two or more types of the resin materials that can be used in the reinforcing fibrous substrate layer 21, as described above. The type and composition of the resin material constituting the $2^{nd}$ resin layer 23 and the resin material constituting the $1^{st}$ resin layer 22 or the reinforcing fibrous substrate layer 21 may be the same or may be different.

From the point of view of mechanical strength, wear resistance and flexibility, in particular urethane resins are preferred as resin material constituting the $2^{nd}$ resin layer 23. Moreover, the 2nd resin layer 23 may also comprise one or more inorganic fillers in the same way as the reinforcing fibrous substrate layer 21. Further, the type and composition of the resin materials and the inorganic fillers in the $2^{nd}$ resin layer 23 may be different in each part of the $2^{nd}$ resin layer 23 or it may be the same.

The dimensions of the wet paper web transfer belt 1 described above are not particularly limited, as they may be suitably set according to the use of the wet paper web transfer belt. The width of the wet paper web transfer belt 1 is not particularly limited, however, it may, for example, be 700 to 13,500 mm, or preferably 2,500 to 12,500 mm. The length of the wet paper web transfer belt 1 is not particularly limited, however, it may, for example, be 4 to 35 m, or preferably 10 to 30 m.

Moreover, the thickness of the wet paper web transfer belt 1 is not particularly limited, however, it may, for example, be 1.5 to 7.0 mm, or preferably 2.0 to 6.0 mm. The sheet edge regions 222, the center region 223 and the border regions 224 of the wet paper web transfer belt 1 may each have a different thickness or may all have the same thickness.

Nevertheless, it is preferred that the thickness of the parts corresponding to the sheet edge regions 222 of the wet paper web transfer belt 1 and the thickness of the part corresponding to the center region 223 of the wet paper web transfer belt 1 are equivalent. Specifically, it is preferred that the difference in the before-mentioned thickness is 0.15 μm or less, even more preferred is 0.1 μm or less. By this means, the wet paper web is uniformly compressed in the parts corresponding to the sheet edge regions 222 and the center region 223 when it is pressed together with the wet paper web transfer belt 1. The result is that, for example, such problems as the deterioration of the paper strength, when the water content of the wet paper web increases in the parts that are not sufficiently compressed at edge parts' vicinity of the wet paper web, are more reliably prevented. Moreover, such problems as the "floating edges" phenomenon, which tends to occur when a water film cannot be formed between the wet paper web surface and the wet paper web transfer belt 1 when the water content of the wet paper web is too small because the edge parts' vicinity was excessively compressed, are also prevented.

Further, the reason why the thickness of the parts corresponding to the sheet edge regions 222 and the part corresponding to the center region 223 in the wet paper web transfer belt 1 can be reduced is that the resin layer 22 of the wet paper web transfer belt 1 consists mainly of a resin material. In case the wet paper web contacting surface corresponding to the sheet edge regions and the center region are adjusted in felts, and the like, in the same way as in the instant application, it is important to polish the felt fibers, or to change the fineness and unit weight of the felt fibers corresponding to each region. In such a case, it is difficult to guarantee a thickness difference in a felt with relatively high surface roughness such as the preferred thickness difference in the above described wet paper web transfer belt 1.

Thus, according to the instant application, it is possible to provide a wet paper web transfer belt having excellent wet paper web transfer properties wherein phenomena such as "paper robbing" and "floating edges", and the like, are simultaneously suppressed. In particular, by setting the surface state of the wet paper web contacting surface in consideration of the basis weight of the wet paper web to be transferred and the swelling rate of the resin layer constituting the wet paper web contacting surface of the wet paper web transfer belt with water, it is possible to provide a wet paper web transfer belt wherein the above-described wet paper web transfer properties corresponding to different types of paper (in particular paper of different basis weight) of the papermaking step can be realized.

Moreover, as a modified embodiment of the wet paper web transfer belt, an embodiment can, for example, be mentioned in which the roll side layer is not a layer constituted by a resin material, but a batt fiber layer formed by needling a batt fiber. Further, as another modified embodiment of the wet paper web transfer belt, an embodiment can, for example, be mentioned which comprises a layer in which the above-mentioned batt fibers are impregnated by resins as those mentioned above. In either embodiment, except for the roll side layer, the same constitution as in the above-mentioned wet paper web transfer belt 1 can be adopted.

Moreover, as batt fiber material, it is possible to use one type or a combination of two or more types of the materials that can be used in the reinforcing fibrous substrate layer 211.

Figure 3:
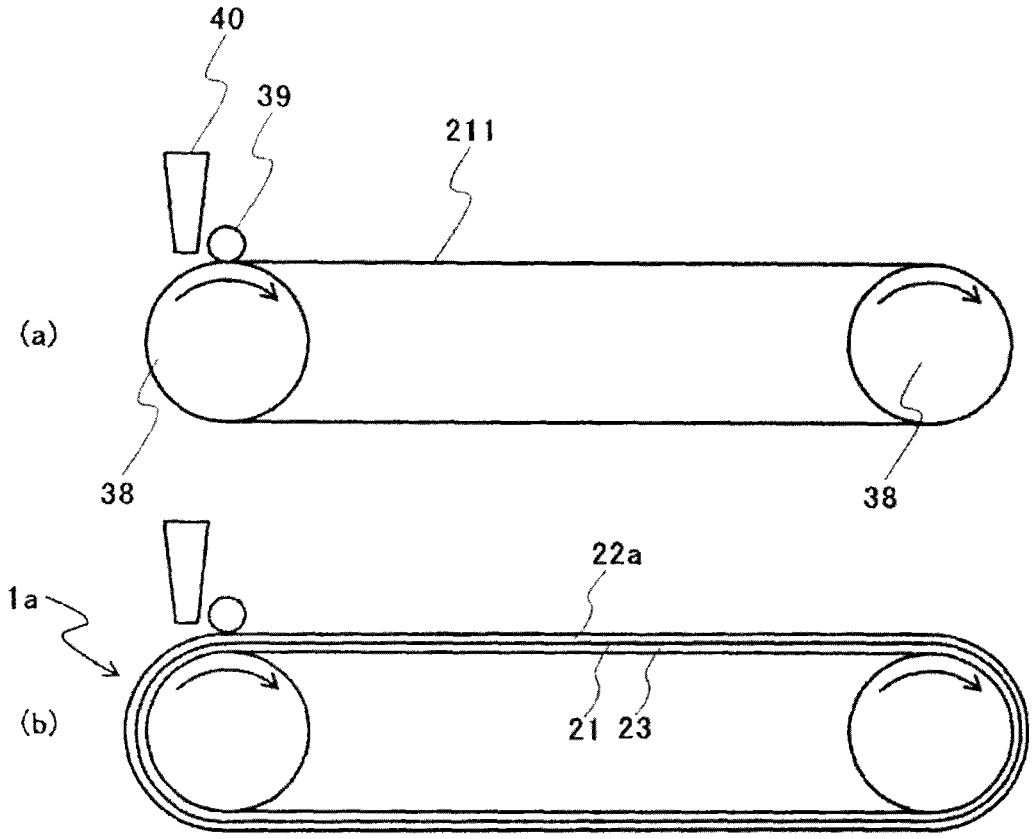
FIGS. 3(*a*) and 3(*b*) are schematic diagrams showing one example of the laminating step in a preferred embodiment of a production method of a wet paper web transfer belt.
Figure 4:
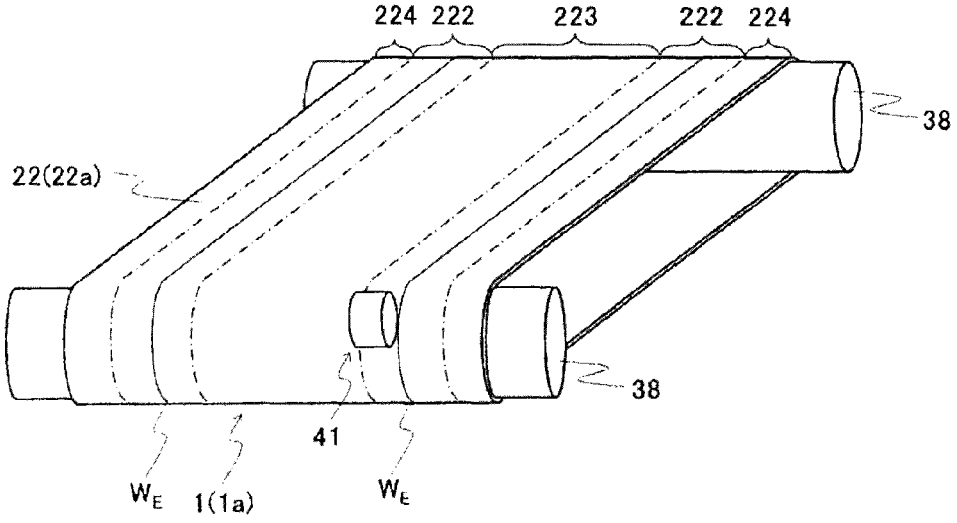
FIG. 4 is a schematic diagram showing one example of the 1st resin layer forming step in a preferred embodiment of a production method of a wet paper web transfer belt.

Next, one example of a preferred embodiment of a production method of the above-mentioned wet paper web transfer belts will be explained. FIGS. 3(*a*) and 3(*b*) are schematic diagrams showing one example of the laminating step in a preferred embodiment of a production method of a wet paper web transfer belt, and FIG. 4 is a schematic diagram showing one example of the 1st resin layer forming step in a preferred embodiment of a production method of a wet paper web transfer belt.

The production method of the wet paper web transfer belt 1 according to the present embodiment comprises a step for forming an annular laminated body 1*a* comprising a $1^{st}$ resin layer precursor 22*a* as outermost layer (laminating step) and a step for forming the $1^{st}$ resin layer 22 by adjusting the surface roughness of the outer surface of the $1^{st}$ resin layer precursor 22*a* ($1^{st}$ resin layer forming step) in the regions corresponding to the sheet edge regions 222 and the center region 223, respectively.

Firstly, in the laminating step, the annular and band-shaped laminated body 1*a* comprising the $1^{st}$ resin layer precursor 22*a* as outermost layer is formed. The laminated body 1*a* may be formed by any method; however, in the present embodiment, the reinforcing fibrous substrate layer 21 is formed, and, at the same time, the $1^{st}$ resin layer precursor 22*a* and a $2^{nd}$ resin layer 23 are formed on both sides of the reinforcing fibrous substrate layer 21 by coating a resin material on the reinforcing fibrous substrate 211 so that the resin material penetrates the reinforcing fibrous substrate 211. Specifically, as shown in FIG. 3(*a*), the annular and band-shaped reinforcing fibrous substrate 211 is installed so as to be in contact with two rolls 38 arranged in parallel.

Next, as shown in FIG. 3(*b*), a resin material is applied to the outer surface of the reinforcing fibrous substrate 211. The resin material may be applied by any method, however, in the present embodiment, the resin material is applied to the reinforcing fibrous substrate 211 by discharging the resin material from a resin discharge opening 40 while the rolls 38 rotate. Moreover, at the same time, the applied resin material is coated uniformly onto the reinforcing fibrous substrate 211 by using a coating bar 39. The resin material coated at this time can penetrate the reinforcing fibrous substrate 211. Therefore, in the present embodiment, it is possible to apply the resin comprised in the reinforcing fibrous substrate 211 and, at the same time, the resin material constituting the $1^{st}$ resin layer precursor 22*a* and the $2^{nd}$ resin layer 23.

Moreover, the resin material may also be applied as a mixture with the above-mentioned inorganic filler.

Moreover, the type and composition of the resin material and the inorganic filler forming the parts corresponding to the sheet edge regions 222, the center region 223, the border regions, respectively, may be different or may be the same. By this means, it is, for example, possible to use a different surface roughness and swelling properties in water in each region of the wet paper web contacting surface 221 of the $1^{st}$ resin layer 22 that is being formed. For example, by using a relatively large amount of inorganic filler in the part corresponding to the center region 223 and a smaller amount of inorganic filler in the parts corresponding to the other regions, it is possible to obtain an arithmetic average surface roughness of the wet paper web contacting surface 221 corresponding to the center region 223 which is greater than the arithmetic average surface roughness of the wet paper web contacting surface 221 corresponding to the other regions.

Next, the coated resin material is cured. By this means, the laminated body 1*a*, in which the layers are laminated from the outer surface in the order of the $1^{st}$ resin layer precursor 22*a*, the reinforcing fibrous substrate layer 21 and the $2^{nd}$ resin layer 23, is obtained. The method for curing the resin material is not particularly limited, however, the curing may, for example, be performed by heating, UV irradiation, and the like.

Moreover, in case the resin material is cured by heating, for example, a far infrared heater or other method may be used.

Further, in case the resin material is cured by heating, the heating temperature of the resin material is preferably 60 to 150° C., and still more preferably 90 to 140° C. Furthermore, the heating time can, for example, be 2 to 24 hours, and preferably 3 to 20 hours.

Next, in the $1^{st}$ resin layer forming step, the surface roughness of the outer surface of the $1^{st}$ resin layer precursor 22*a* is adjusted in the regions corresponding to the sheet edge regions 222 and the center region 223, respectively, and the $1^{st}$ resin layer 22 comprising the wet paper web contacting surface 221 is formed. By this means, the wet paper web contacting surface 221 is formed and the wet paper web transfer belt 1 is obtained.

The surface roughness of the outer surface can, for example, be adjusted by polishing and/or buffing. Specifically, as shown in FIG. 4, this step is performed by bringing a polishing device 41 or buffing device (not shown in the drawing) into contact with the laminated body 1*a* as it is installed on the two rolls 38.

As a method and order of use of the polishing device 41 and the buffing device, for example, first, the entire outer surface of the $1^{st}$ resin layer precursor 22*a* is polished, and next, the outer surface corresponding to the sheet edge regions 222 is polished and/or buffed. By this means, the arithmetic average surface roughness of the wet paper web contacting surface 221 in the center region 223 can be greater than the arithmetic average surface roughness of the wet paper web contacting surface 221 in the sheet edge regions 222.

Further, it is also possible not to polish and buff the outer surface corresponding to the border regions 224 of the $1^{st}$ resin layer precursor 22*a*. Nevertheless, the parts corresponding to the border regions 224 of the wet paper web transfer belt 1 are brought into contact with the roll edges during pressing. Therefore, in consideration of the load applied by the roll edge, it is preferred to perform the machining so that the thickness of the parts corresponding to the border regions 224 of the wet paper web transfer belt 1 is smaller than the thickness of the parts corresponding to the sheet edge regions 222.

Moreover, in case different types and compositions of resin material and inorganic filler are used in the parts corresponding to the sheet edge regions 222, the center region 223, the border regions 224 of the $1^{st}$ resin layer precursor 22*a*, respectively, it is possible to obtain the desired wet paper web contacting surface 221 of the wet paper web transfer belt 1 by polishing or buffing the entire outer surface of the $1^{st}$ resin layer precursor 22*a*. In this case, when the wet paper web contacting surface 221 of the wet paper web transfer belt 1 has the desired state before polishing or buffing, the present step may be omitted.

Further, as a modified embodiment of the above-described production method of the wet paper web transfer belt 1, there is an embodiment in which, instead of the reinforcing fibrous substrate 211, a reinforcing fibrous substrate is used in which batt fibers are needled. By this means, it is possible to obtain a wet paper web transfer belt comprising a batt fiber layer as roll-side layer or a wet paper web transfer belt comprising a roll-side layer wherein the batt fiber layer is impregnated by a resin, as described above.

Figure 5:
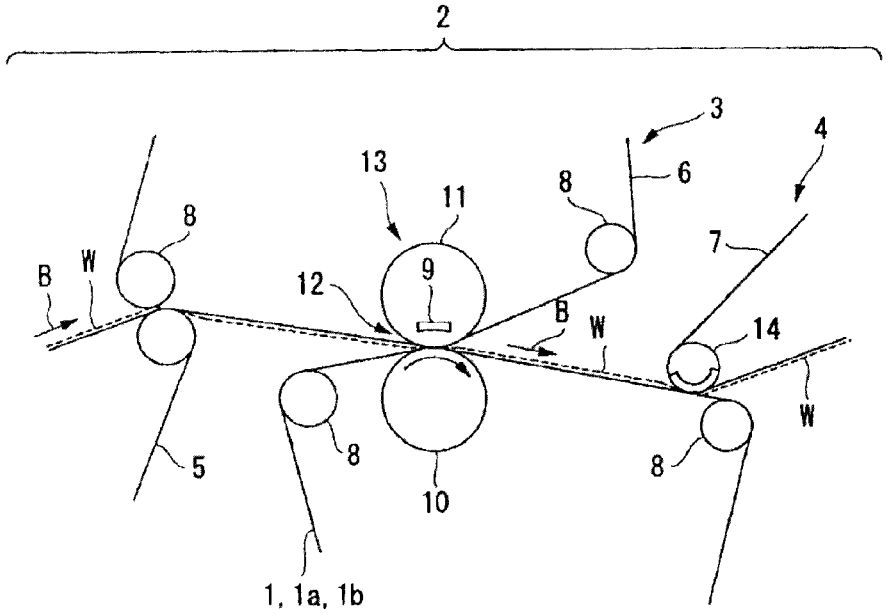
FIG. 5 is a schematic diagram showing one example of a part of the press part in a preferred embodiment of a papermaking system.

Next, a papermaking system will be explained. FIG. 5 is a schematic diagram showing one example of a part of the press part in a preferred embodiment of a papermaking system according to the present invention. The papermaking system comprises a press part for squeezing water from a wet paper web; the press part is configured to pass, in at least one of its parts, a wet paper web in a closed draw by using the wet paper web transfer belt according to the instant application.

Moreover, in the present embodiment, a papermaking system 2 comprises a wire part (not shown in the drawing) for dewatering a pulp slurry and forming a wet paper web, a press part 3 for squeezing water from the wet paper web, and a dryer part 4 for drying the wet paper web from which water has been squeezed. The wire part, press part 3 and dryer part 4 are arranged along the transfer direction (arrow B direction) of the wet paper web in the order of these steps.

The wire part is configured to dewater pulp slurry supplied from a head box while it is carried and transferred by wires, and to form a wet paper web. The wet paper web formed is transferred to the press part 3. In the present embodiment, a wire part of a publicly known constitution can be used. Therefore, the detailed description is omitted.

Next, the press part 3 is configured so as to squeeze water from the wet paper web transferred from the wire part. In general, press parts are publicly known. Moreover, in the present embodiment, a publicly known constitution can be used for certain parts of the press part 3. Therefore, the detailed description of the publicly known parts of the constitution of press part 3 is omitted.

The press part 3 comprises a press felt (also simply referred to as felt) 5, a press felt 6, a wet paper web transfer belt 1, guide rollers 8 for guiding and rotating the press felts 5, 6 and the wet paper web transfer belt 1, and a press section 12. The press felt 5, the press felt 6 and the wet paper web transfer belt 1 are each a band-shaped body configured to form an endless shape and are supported by the guide rollers 8. The press felts 5, 6, the wet paper web transfer belt 1, and a dryer fabric 7, respectively, support and transfer the wet paper web W in the direction of the arrow B. At this juncture, the wet paper web W is passed from the press felt 5 to the press felt 6 and from the press felt 6 to the wet paper web transfer belt 1. The wet paper web W is passed through the press section 12 in a closed draw from the press felt 6 to the wet paper web transfer belt 1.

Hereinafter the press section 12 will be described. The press section 12 is a compression means constituted by a shoe press mechanism 13 and a press roll 10 arranged in a position facing the shoe press mechanism. The shoe press mechanism 13 comprises a concave shoe 9 facing the press roll 10 and a band-shaped shoe press belt 11 surrounding the shoe 9. Together with the press roll 10, the shoe 9 constitutes the press section 12 via the shoe press belt 11. In the press section 12, the wet paper web W is pressed by the shoe 9 via the shoe press belt 11 and the press roll 10 while being sandwiched between the press felt 6 and the wet paper web transfer belt 1. As a result thereof, moisture is squeezed from the wet paper web W. The press felt 6 is configured to have high water permeability, and the wet paper web transfer belt 1 is configured to have low water permeability. Therefore, in the press section 12, the moisture in the wet paper web W moves to the press felt 6. In this way, in the press part 3, water is squeezed from the wet paper web W and the surface of the wet paper web is smoothed.

Immediately after exiting the press section 12, the wet paper web W, the press felt 6, and the wet paper web transfer belt 1 swell in volume because they are suddenly released from pressure. Due to this swelling and because of the capillary action of the pulp fibers constituting the wet paper web W, the so-called "rewetting phenomenon" occurs in which part of the moisture in the press felt 6 moves to the wet paper web W. Nevertheless, since the water permeability of the wet paper web transfer belt 1 is low, the amount of moisture held inside it is small. Therefore, there is hardly any rewetting due to moisture moving from the wet paper web transfer belt 1 to the wet paper web W, and the wet paper web transfer belt 1 contributes to improving the smoothness of the wet paper web W.

For passing the wet paper web W in the press section 12 in such a manner, it is required of the wet paper web transfer belt 1 that, immediately after exiting the press section 12, the wet paper web W is released from the press felt 6 and positively adheres to the wet paper web contacting surface 221 of the wet paper web transfer belt 1. In general, it is in such parts that the "paper robbing" and "floating edges" phenomena tend to occur. The "paper robbing" described here indicates a phenomenon, in case a common wet paper web transfer belt is used, in which the adhesiveness to the wet paper web contacting surface is weak and the wet paper web passing the press section remains on the press felt without being moved from the press felt to the wet paper web transfer belt. Moreover, the "floating edges" phenomenon generally indicates an occurrence in which, when the wet paper web is transferred, the adhesive force of the wet paper web transfer belt or other papermaking equipment is weak in the sheet edge parts (wet paper web border parts), and the wet paper web border parts are released from the papermaking equipment. Nevertheless, as described above, in the wet paper web transfer belt 1, which has the suitable degree of adhesiveness with the wet paper web in the center region 223 of its wet paper web contacting surface 221, the "floating edges" phenomenon is prevented, and because it has excellent wet paper web transfer properties, the "floating edges" phenomenon and the "paper robbing" by the press felt 6 are prevented.

Moreover, the contacting surface of the press felt 6 with the wet paper web is configured to comprise batt fibers, and the batt fibers preferably fulfill the relation of equation (5) hereinafter $$0.15X \leq Z \leq 0.3X \quad (5),$$

(wherein the symbols are: X=basis weight (g/m$^2$) of the base paper to be produced from the wet paper web to be transferred, Z=fineness (dtex) of the batt fibers, respectively.) By this means, the wet paper web W is more easily released from the press felt 6 and is more reliably passed from the press felt 6 to the wet paper web transfer belt 1.

Moreover, in the same way as the wet paper web transfer belt 1, the press felt 6 can comprise, in the width direction of its wet paper web contacting surface for carrying the wet paper web W, sheet edge regions for carrying the edge parts of the wet paper web and a center region for carrying the center vicinity of the wet paper web, wherein the arithmetic average roughness of its paper web contacting surface in the sheet edge region can be smaller than the arithmetic average roughness of its wet paper web contacting surface in the center region.

Moreover, the wet paper web, having passed the press section 12, is carried and transferred by the wet paper web transfer belt 1 and is passed in a closed draw from the wet paper web transfer belt 1 to the dryer fabric 7 of the dryer part 4. The suction roll 14 of the dryer part 4, provided to support the dryer fabric 7, releases the wet paper web W adhering to the wet paper web transfer belt 1 by suction and causes it to adhere to the surface of the dryer fabric 7. The wet paper web transfer belt 1 has excellent wet paper web transfer properties and the suitable properties for releasing the wet paper web W from the wet paper web contacting surface 221. Therefore, in this case too, the "paper robbing" phenomenon is prevented when the wet paper web is passed.

The dryer part 4 is configured to dry the wet paper web W. In the present embodiment, a publicly known constitution can be used as dryer part 4, therefore, the detailed description is omitted. The wet paper web W is dried and becomes base paper by passing through the dryer part 4.

Thus, in the papermaking system, by using a wet paper web transfer belt with excellent wet paper web transfer properties, it is possible to simultaneously suppress the "paper robbing", "floating edges" and other phenomena, and to improve production stability. In particular, by setting the surface state of the wet paper web contacting surface in consideration of the basis weight of the wet paper web to be transferred and the swelling rate of the resin layer constituting the wet paper web contacting surface of the wet paper web transfer belt used with water, it is possible to realize the above-described wet paper web transfer properties corresponding to different types of paper (in particular paper of different basis weight) of the papermaking step.

Next, a papermaking method according to the present invention will be described by referring to a preferred embodiment. The papermaking method comprises a step in which water is squeezed from a wet paper web formed by dewatering a pulp slurry. In this step, the wet paper web is passed in a closed draw by using a wet paper web transfer belt.

Moreover, the papermaking method comprises a step for forming a wet paper web by dewatering a pulp slurry (dewatering step), a step for squeezing water from the wet paper web (water squeezing step), and a step for drying the wet paper web (drying step).

Further, the dewatering step and the drying step can each be performed by a publicly known method, therefore, the detailed description will be omitted. For example, the dewatering step and the drying step can be performed by using the above-mentioned wire part and dryer part 4, respectively. In the water squeezing step, water is further squeezed from the wet paper web obtained in the dewatering step.

In the present embodiment, the wet paper web is passed in a closed draw by using the above-described wet paper web transfer belt in the water squeezing step. By using a wet paper web transfer belt having excellent wet paper web transfer properties, the "floating edges" and "paper robbing" phenomena are prevented. Moreover, by suitably using a wet paper web transfer belt matching the basis weight of the base paper, it is possible to prevent such "floating edges" and "paper robbing" phenomena for different types of paper. In particular, it is preferred to move the wet paper web in a closed draw from a felt to the wet paper web transfer belt. In this case, the above-mentioned "floating edges" and "paper robbing" phenomena are prevented with greater reliability.

Moreover, it is preferred that the batt fibers constituting the contacting surface of the above-mentioned felt with the wet paper web fulfill the relation of equation (5). In this case, problems such as the "floating edges" and the "paper robbing" described above can be prevented with greater reliability.

Moreover, in the same way as the wet paper web transfer belt according to the instant application, the above-mentioned felt may comprise a wet paper web contacting surface for carrying the wet paper web, and said wet paper web contacting surface may comprise, in the width direction, sheet edge regions for carrying the edge parts of the wet paper web and a center region for carrying the center vicinity of the wet paper web, and the arithmetic average roughness of the wet paper web contacting surface in the sheet edge regions may be smaller than the arithmetic average roughness of the wet paper web contacting surface in the center region.

Moreover, the water squeezing step may be performed by using the press part 3 described above.

Thus, in the papermaking method described herein, by using a wet paper web transfer belt with excellent wet paper web transfer properties, it is possible to simultaneously suppress the "paper robbing", "floating edges" and other phenomena, and to improve production stability. In particular, by setting the surface state of the wet paper web contacting surface in consideration of the basis weight of the wet paper web to be transferred and the swelling rate of the resin layer constituting the wet paper web contacting surface of the wet paper web transfer belt used with water, it is possible to realize the above-described wet paper web transfer properties corresponding to different types of paper (in particular paper of different basis weight) of the papermaking step.

Above, the instant application has been described in detail based on preferred embodiments, however, the instant application is not limited by this. Each constitution may be substituted as desired, or a constitution may be added as desired, as long as a similar function can be obtained.

EXAMPLES

Hereinafter, the instant application will be described even more specifically by means of the Examples, however, the instant application is not limited to these Examples.

1. Production of a Wet Paper Web Transfer Belt

Firstly, the wet paper web transfer belts of Examples 1 to 63 and Comparative Examples 1 to 18 were produced according to the constitution hereinafter.

The Reinforcing Fibrous Substrate

The following constitution was used for the reinforcing fibrous substrate of the wet paper web transfer belts of Examples 1 to 63 and Comparative Examples 1 to 18:

Upper warp yarn: twisted monofilament of 2000 dtex made from polyamide 6

Lower warp yarn: twisted monofilament of 2000 dtex made from polyamide 6

Weft yarn: twisted monofilament of 1400 dtex made from polyamide 6

Weave: double warp weave of 40 upper/lower warp yarns/5 cm and 40 weft yarns/5 cm The reinforcing fibrous substrate was made by entangling and integrating batt fibers of 20 dtex made from polyamide 6 with the woven fabric of the above constitution by needling 300 g/m$^2$ of the batt fibers to the roll side of the woven fabric.

The Resin Material

The resin material of the wet paper web transfer belt of Examples 1 to 21 and Comparative Examples 1 to 6 was obtained by reacting a mixture of tolylenediisocyanate (TDI) and polytetramethylene glycol (PTMG), as urethane prepolymer, with Dimethylthiotoluenediamine (DMTDA), as curing agent.

The resin material of the wet paper web transfer belts of Examples 22 to 42 and Comparative Examples 7 to 12 was obtained by reacting an anionic urethane dispersion with a melamine/formaldehyde cross-linking agent.

The resin material of the wet paper web transfer belts of Examples 43 to 63 and Comparative Examples 13 to 18 was obtained by reacting a mixture of a prepolymer mixed from tolylenediisocyanate (TDI) and polyethylene glycol and a prepolymer mixed from tolylenediisocyanate (TDI) and polytetramethylene glycol (PTMG), as urethane prepolymers, with Dimethylthiotoluenediamine (DMTDA), as curing agent.

Moreover, all of the resin materials are impermeable to water.

The Wet Paper Web Transfer Belt (Semi-finished Product)

For the wet paper web transfer belts of Examples 1 to 63 and Comparative Examples 1 to 18, the reinforcing fibrous substrate was impregnated with the above-mentioned resin material from its wet paper web contacting side to the center part of the woven fabric of the reinforcing fibrous substrate, and said resin material was laminated and cured to obtain the semi-finished product of the wet paper web transfer belt comprising a resin layer forming a wet paper web contacting surface at the wet paper web mounting surface side of the reinforcing fibrous substrate. Moreover, the length and width were 20 m and 900 mm, respectively; and the sheet width (distance between the sheet edges) used in the test for confirming the wet paper web transfer conditions was 700 mm.

The Polishing and Buffing

For polishing the wet paper web contacting surface (sheet edge regions, center region, border regions) of the wet paper web transfer belts of Examples 1 to 63 and Comparative Examples 1 to 18, grit 80 to 600 polishing paper or cloth was suitably installed in a polishing device. Further, the sheet edge regions had each width of 10 cm from the sheet edges to the directions of the center region and the border regions, i.e., a total width of 20 cm. Moreover, buffing was suitably performed for adjusting the surface roughness of the wet paper web contacting surface. In this way, the wet paper web transfer belts were completed.

The Swelling Rate of the Resin Material

The swelling rates in water of the resin material used in the Examples and Comparative Examples were as shown in Tables 2 to 4 hereinafter.

2. Evaluation of the Transfer

Figure 6:
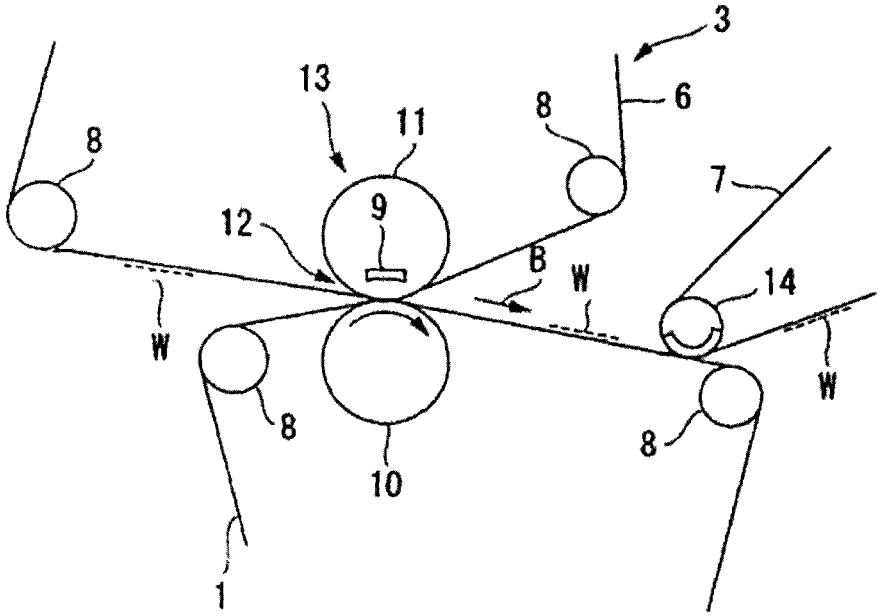
FIG. 6 is a schematic diagram showing a device for evaluating a wet paper web transfer belt.

The evaluation device of wet paper web transfer belts shown in FIG. 6 was used to evaluate the wet paper web "floating edges" state and the "paper robbing" by the felt 6 or the wet paper web transfer belt after the wet paper web W had passed the press nip 12 under the conditions hereinafter. Further, the evaluation device shown in FIG. 6 is identical to the device in FIG. 5, except that the constitution upstream of the press felt 6 has been omitted from the constitution of the press part 3. Moreover, the pressing conditions, the constitution of the press felt 6 and the constitution of the wet paper web were as described hereinafter.

The Pressing Conditions

Papermaking speed: 1600 m/min

Pressing pressure: 1050 kN/m

The Constitution of the Press Felt 6

The constitution of the base fabric of the press felt 6 was identical in all Examples while the fineness of the batt fibers was changed according to the basis weight of the raw material of the wet paper web.

Base fabric: laminated base fabric

Upper Fabric Base Fabric

Warp yarn: monofilament of 500 dtex made from polyamide 6

Weft yarn: monofilament of 1500 dtex made from polyamide 6

Weave: 3/1 broken weave of 40 warp yarns/5 cm and 90 weft yarns/5 cm

Lower Fabric Base Fabric

Warp yarn: twisted monofilament of 2000 dtex made from polyamide 6

Weft yarn: twisted monofilament of 1400 dtex made from polyamide 6

Weave: 3/1 broken weave of 40 warp yarns/5 cm and 40 weft yarns/5 cm

Batt Fibers Needled to the Base Fabric (for base paper with a basis weight of 30 g/m$^2$)

Front layer batt fiber: 200 g/m$^2$ batt fiber of 6 dtex made from polyamide 6

Center layer batt fiber: 400 g/m$^2$ batt fiber of 20 dtex made from polyamide 6

Rear layer batt fiber: 400 g/m$^2$ batt fiber of 20 dtex made from polyamide 6

(for base paper with a basis weight of 100 g/m$^2$)

Front layer batt fiber: 200 g/m$^2$ batt fiber of 20 dtex made from polyamide 6

Center layer batt fiber: 400 g/m$^2$ batt fiber of 20 dtex made from polyamide 6

Rear layer batt fiber: 400 g/m$^2$ batt fiber of 20 dtex made from polyamide 6

(for base paper with a basis weight of 200 g/m$^2$)

Front layer batt fiber: 200 g/m$^2$ batt fiber of 40 dtex made from polyamide 6

Center layer batt fiber: 400 g/m$^2$ batt fiber of 40 dtex made from polyamide 6

Rear layer batt fiber: 400 g/m$^2$ batt fiber of 40 dtex made from polyamide 6

Felt moisture: felt moisture weight/(felt moisture weight+felt weight per unit area)=adjusted to 30%

The Wet Paper Web (Handsheet)

Pulp: LBK 100% csf 300 mL

Basis weight: 30 g/m$^2$, 100 g/m$^2$, 200 g/m$^2$

Wet paper web moisture before pressing: wet paper web moisture weight before pressing/(wet paper web moisture weight before pressing+wet paper web bone dry weight)= adjusted to 60% (moisture control by sandwiching with filter paper, wet paper web moisture after pressing about 50%)

Wet paper size: 700 mm length by 700 mm width

Further, after passing the nip, the wet paper web "floating edge" state and the "paper robbing" by the felt 6 or the wet paper web transfer belt was evaluated with the help of a video camera.

The wet paper web transfer state was compared and evaluated for the wet paper web transfer belts of Examples 1 to 63 and Comparative Examples 1 to 18. The properties, evaluation conditions and evaluation results of the wet paper web transfer belts are shown in Tables 2 to 4. Further, the graphs in FIGS. 7 to 10 show the relation between the surface roughness and the swelling rate of the wet paper web transfer belts of each Example and Comparative Example for base paper of a basis weight of 30 to 200 g/m$^2$, respectively.

Figure 7A:
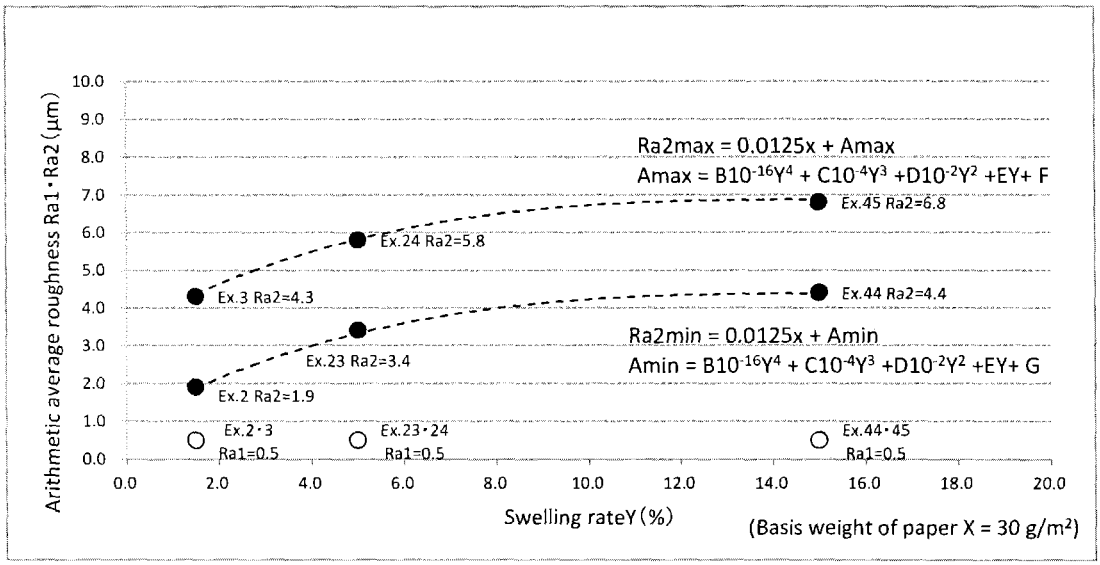
FIGS. 7 (*a*) to (*c*) are graphs showing the relation between the swelling rate and the surface roughness of the wet paper web transfer belts in the Examples under the condition in which base paper with a basis weight of 30 g/m$^2$.
Figure 7B:
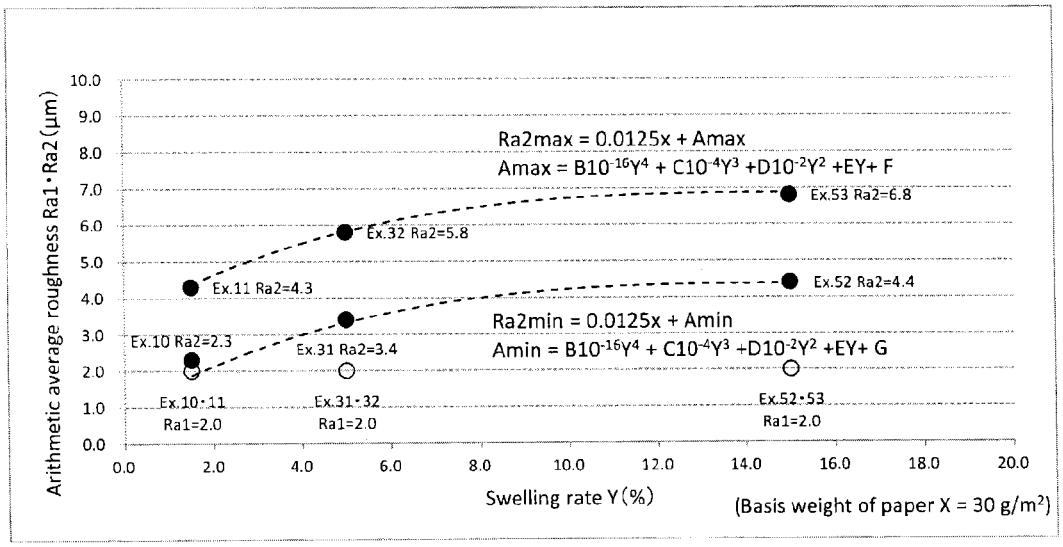
Figure 7C:
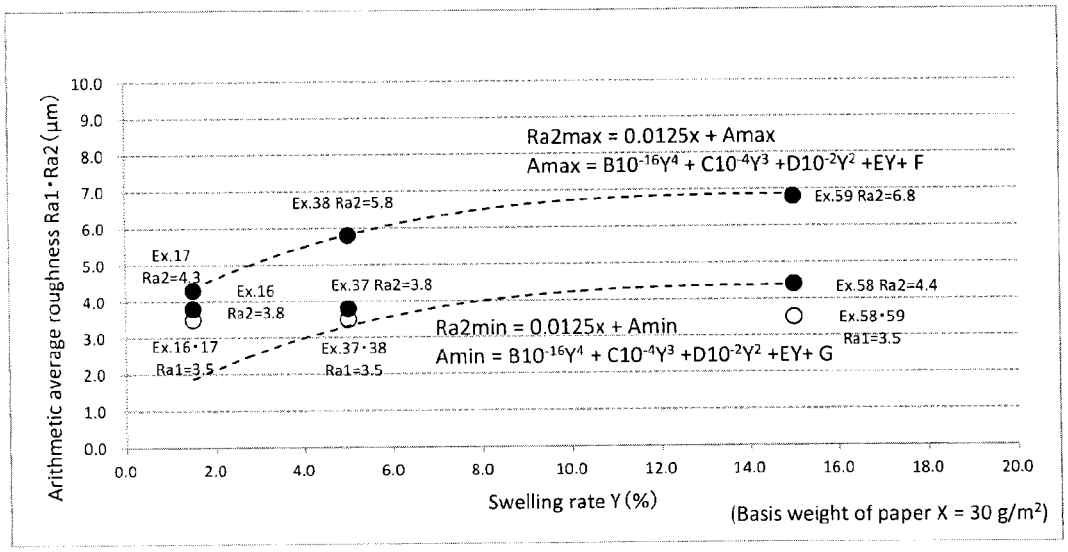
Figure 8A:
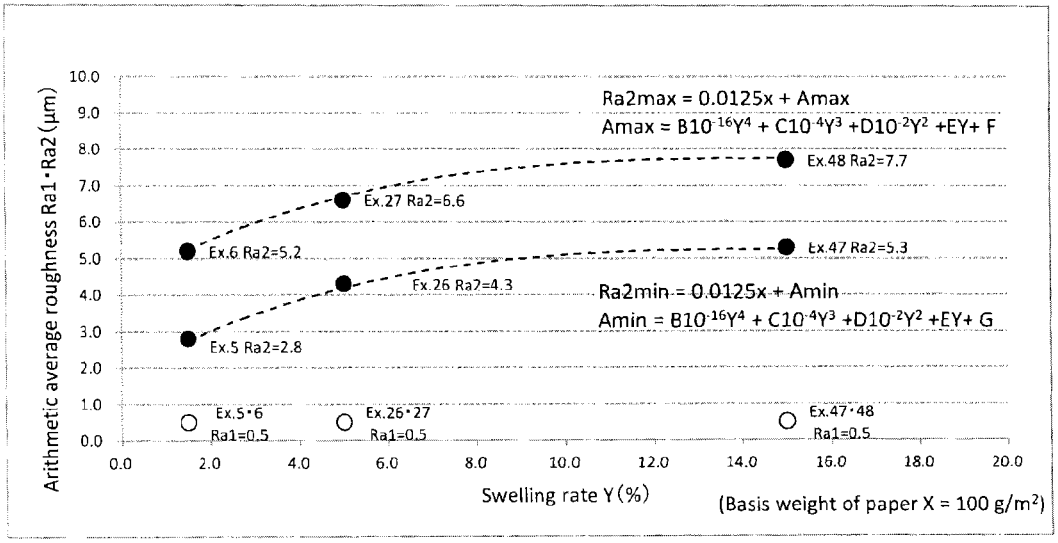
FIGS. 8 (*a*) to (*c*) are graphs showing the relation between the swelling rate and the surface roughness of the wet paper web transfer belts in the Examples under the condition in which base paper with a basis weight of 100 g/m$^2$.
Figure 8B:
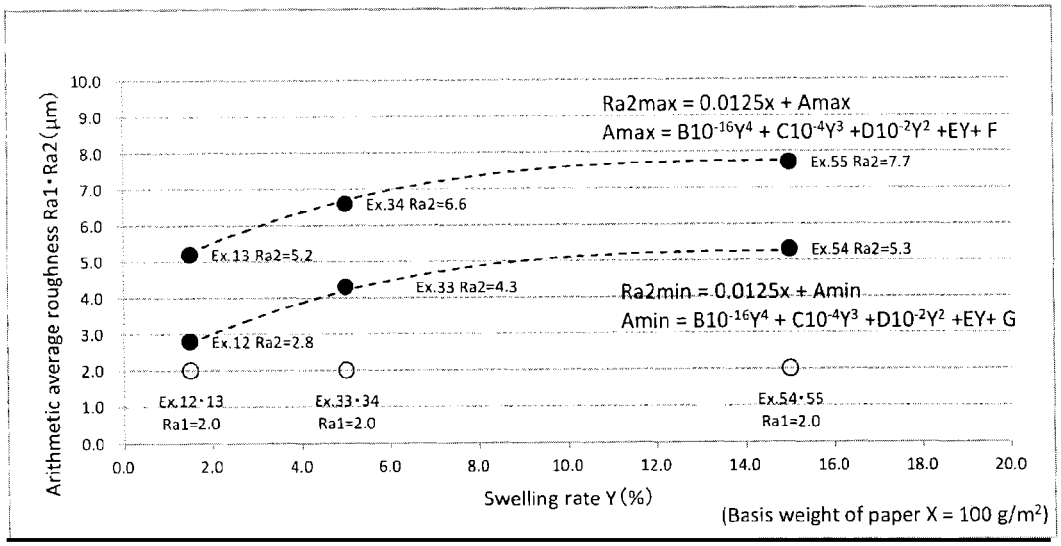
Figure 8C:
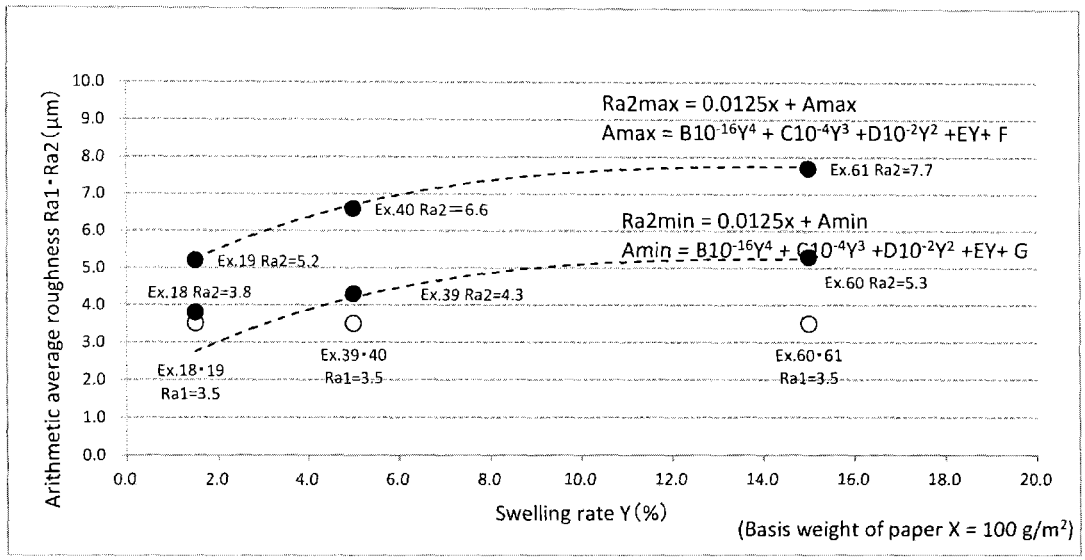
Figure 9A:
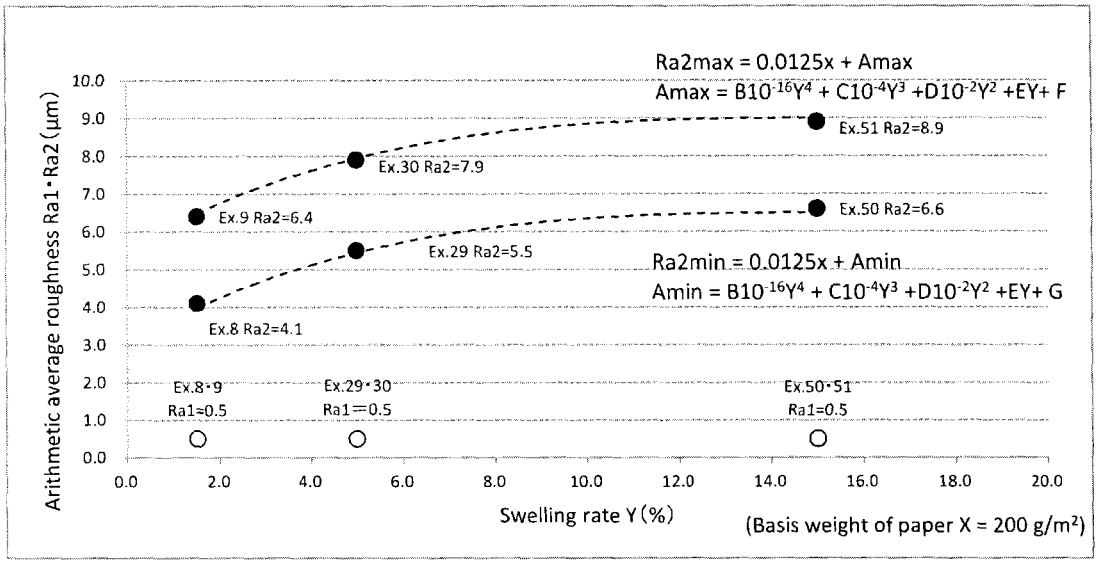
FIGS. 9 (*a*) to (*c*) are graphs showing the relation between the swelling rate and the surface roughness of the wet paper web transfer belts in the Examples under the condition in which base paper with a basis weight of 200 g/m$^2$.
Figure 9B:
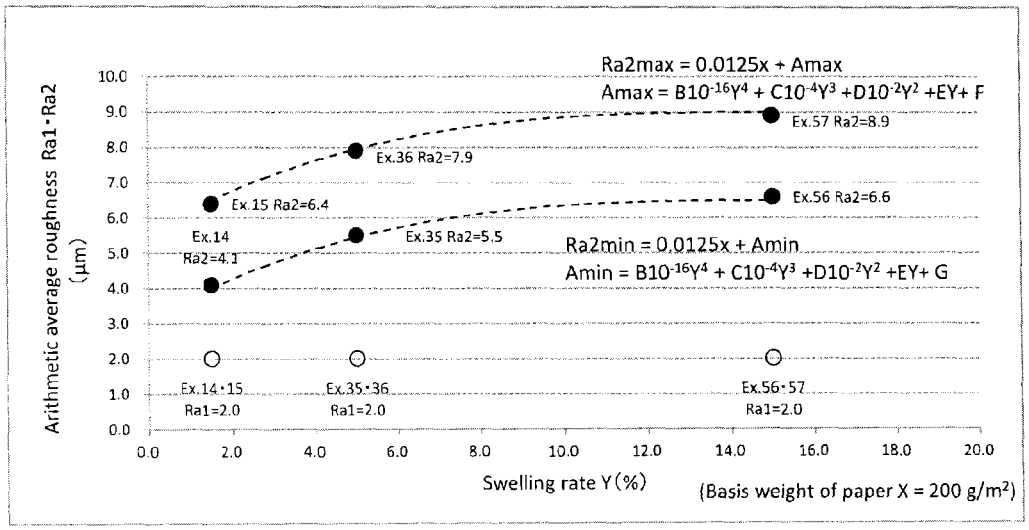
Figure 9C:
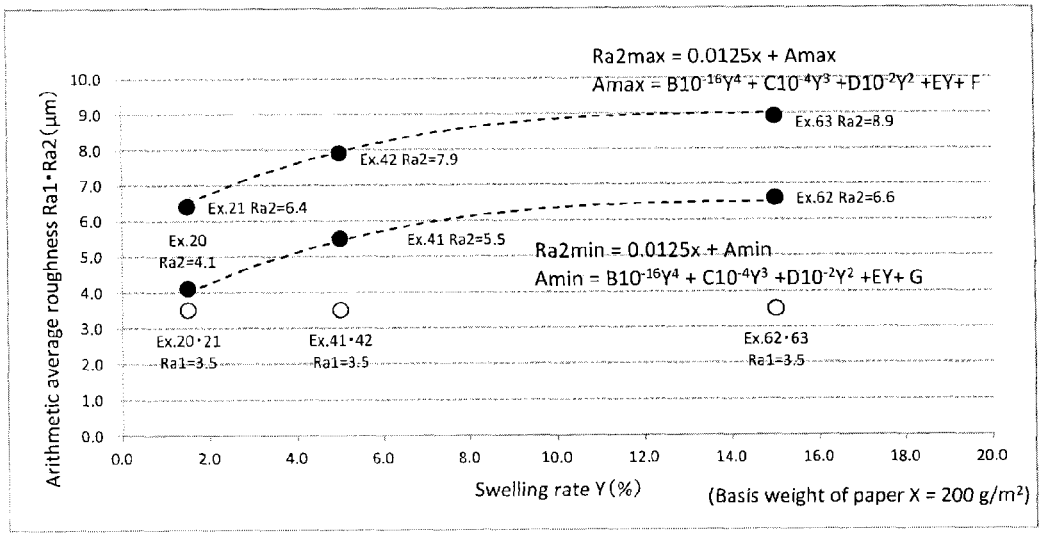
Figure 10A:
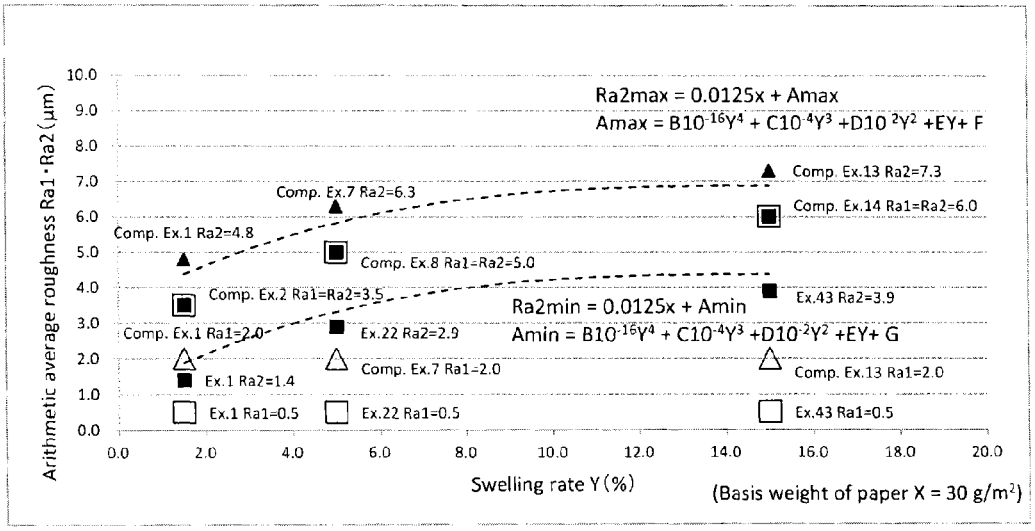
FIGS. 10 (*a*) to (*c*) are graphs showing the relation between the swelling rate and the surface roughness of the wet paper web transfer belts in the Comparative Examples under the condition, in which base paper with a basis weight of 30 g/m$^2$ (a), 100 g/m$^2$ (b) or 200 g/m$^2$, respectively.
Figure 10B:
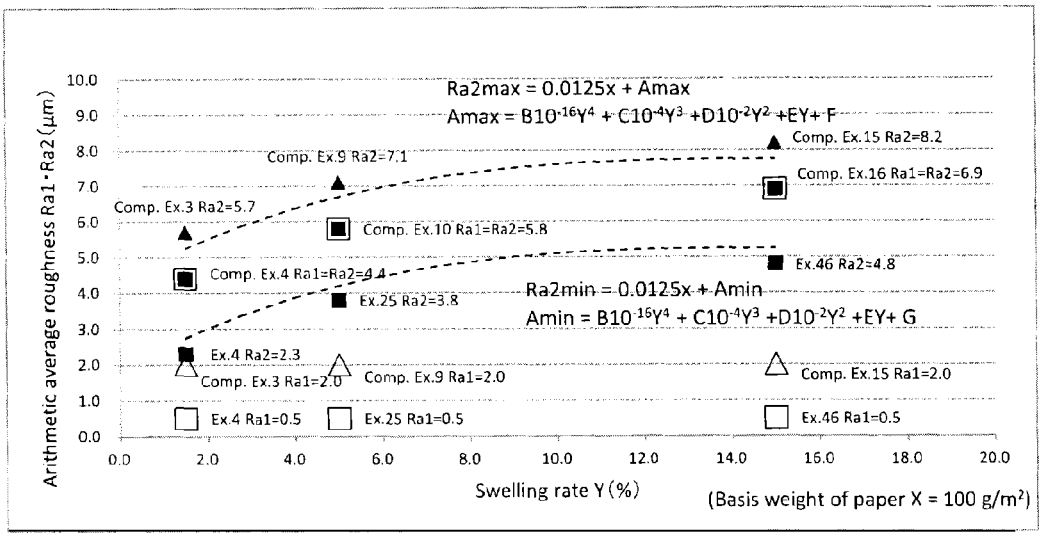
Figure 10C:
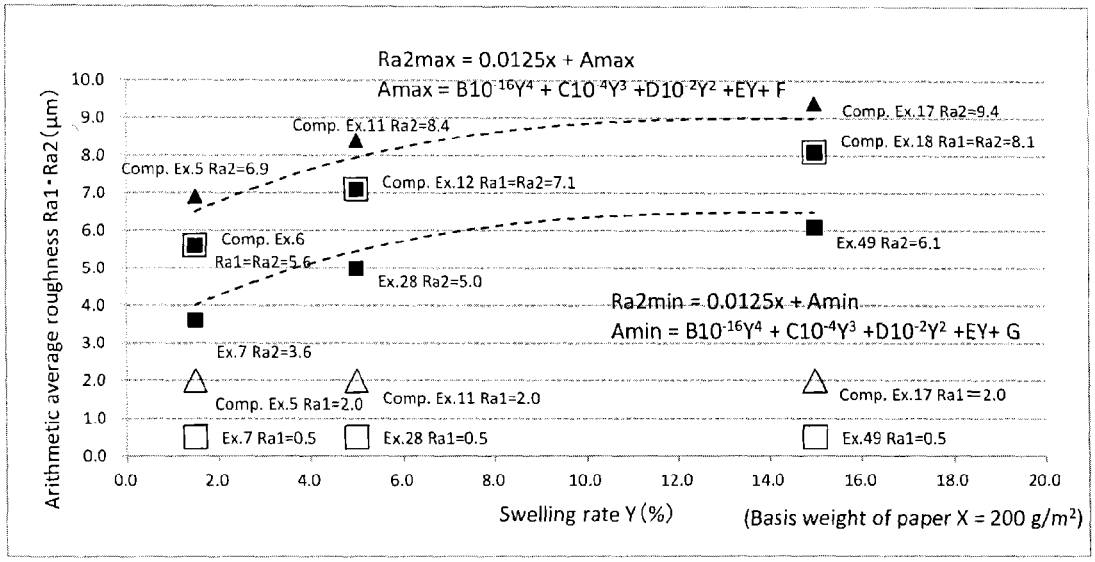

Further, in the graphs of FIGS. 7 to 10, the dotted line corresponding to "Ra2max" is the greatest arithmetic average surface roughness (μm) fulfilling the relations of equations (1) and (2) in the tests of the Examples and the Comparative Examples; and the dotted line corresponding to "Ra2min" is the smallest arithmetic average surface roughness (μm) fulfilling the relations of equations (1) and (3) in the tests of the Examples and Comparative Examples. In FIGS. 7 to 9, the results from the Examples are plotted which fulfill the relations of equations (1) to (3) and in which $Ra_1$ is smaller than $Ra_2$. In FIG. 10, the results from the Examples are plotted which fulfill the relations of equations (1) and (2), while not fulfilling the relations of equations (1) and (3); and the results from the Comparative Examples are plotted which either do not fulfill the relations of equations (1) and (2), or in which $Ra_1$ and $Ra_2$ are equal.

TABLE 2

| Example | Wet paper web transfer belt properties: Swelling rate Y (%) | Roughness of the wet paper web contacting surface: Sheet edge regions Ra1 (μm) | Roughness of the wet paper web contacting surface: Center region Ra2 (μm) | Evaluation condition: Basis weight of the paper (g/m$^2$) | Evaluation item (evaluation result): "Paper robbing"by the felt | Evaluation item (evaluation result): "Floating edges" | Evaluation item (evaluation result): "Paper robbing" by the wet paper web transfer belt |
|---|---|---|---|---|---|---|---|
| 1 | 1.5 | 0.5 | 1.4 | 30 | no | no | yes |
| 2 | 1.5 | 0.5 | 1.9 | 30 | no | no | no |
| 3 | 1.5 | 0.5 | 4.3 | 30 | no | no | no |
| 4 | 1.5 | 0.5 | 2.3 | 100 | no | no | yes |
| 5 | 1.5 | 0.5 | 2.8 | 100 | no | no | no |
| 6 | 1.5 | 0.5 | 5.2 | 100 | no | no | no |
| 7 | 1.5 | 0.5 | 3.6 | 200 | no | no | yes |
| 8 | 1.5 | 0.5 | 4.1 | 200 | no | no | no |
| 9 | 1.5 | 0.5 | 6.4 | 200 | no | no | no |
| 10 | 1.5 | 2.0 | 2.3 | 30 | no | no | no |
| 11 | 1.5 | 2.0 | 4.3 | 30 | no | no | no |
| 12 | 1.5 | 2.0 | 2.8 | 100 | no | no | no |
| 13 | 1.5 | 2.0 | 5.2 | 100 | no | no | no |
| 14 | 1.5 | 2.0 | 4.1 | 200 | no | no | no |
| 15 | 1.5 | 2.0 | 6.4 | 200 | no | no | no |
| 16 | 1.5 | 3.5 | 3.8 | 30 | no | no | no |
| 17 | 1.5 | 3.5 | 4.3 | 30 | no | no | no |
| 18 | 1.5 | 3.5 | 3.8 | 100 | no | no | no |
| 19 | 1.5 | 3.5 | 5.2 | 100 | no | no | no |
| 20 | 1.5 | 3.5 | 4.1 | 200 | no | no | no |
| 21 | 1.5 | 3.5 | 6.4 | 200 | no | no | no |
| 22 | 5.0 | 0.5 | 2.9 | 30 | no | no | yes |
| 23 | 5.0 | 0.5 | 3.4 | 30 | no | no | no |
| 24 | 5.0 | 0.5 | 5.8 | 30 | no | no | no |
| 25 | 5.0 | 0.5 | 3.8 | 100 | no | no | yes |
| 26 | 5.0 | 0.5 | 4.3 | 100 | no | no | no |
| 27 | 5.0 | 0.5 | 6.6 | 100 | no | no | no |
| 28 | 5.0 | 0.5 | 5.0 | 200 | no | no | yes |
| 29 | 5.0 | 0.5 | 5.5 | 200 | no | no | no |
| 30 | 5.0 | 0.5 | 7.9 | 200 | no | no | no |
| 31 | 5.0 | 2.0 | 3.4 | 30 | no | no | no |
| 32 | 5.0 | 2.0 | 5.8 | 30 | no | no | no |
| 33 | 5.0 | 2.0 | 4.3 | 100 | no | no | no |
| 34 | 5.0 | 2.0 | 6.6 | 100 | no | no | no |
| 35 | 5.0 | 2.0 | 5.5 | 200 | no | no | no |
| 36 | 5.0 | 2.0 | 7.9 | 200 | no | no | no |

TABLE 3

| Example | Wet paper web transfer belt properties: Swelling rate Y (%) | Roughness of the wet paper web contacting surface: Sheet edge regions Ra1 (μm) | Roughness of the wet paper web contacting surface: Center region Ra2 (μm) | Evaluation condition: Basis weight of the paper (g/m$^2$) | Evaluation item (evaluation result): "Paper robbing" by the felt | Evaluation item (evaluation result): "Floating edges" | Evaluation item (evaluation result): "Paper robbing" by the wet paper web transfer belt |
|---|---|---|---|---|---|---|---|
| 37 | 5.0 | 3.5 | 3.8 | 30 | no | no | no |
| 38 | 5.0 | 3.5 | 5.8 | 30 | no | no | no |
| 39 | 5.0 | 3.5 | 4.3 | 100 | no | no | no |
| 40 | 5.0 | 3.5 | 6.6 | 100 | no | no | no |
| 41 | 5.0 | 3.5 | 5.5 | 200 | no | no | no |
| 42 | 5.0 | 3.5 | 7.9 | 200 | no | no | no |
| 43 | 15.0 | 0.5 | 3.9 | 30 | no | no | yes |
| 44 | 15.0 | 0.5 | 4.4 | 30 | no | no | no |
| 45 | 15.0 | 0.5 | 6.8 | 30 | no | no | no |
| 46 | 15.0 | 0.5 | 4.8 | 100 | no | no | yes |
| 47 | 15.0 | 0.5 | 5.3 | 100 | no | no | no |
| 48 | 15.0 | 0.5 | 7.7 | 100 | no | no | no |
| 49 | 15.0 | 0.5 | 6.1 | 200 | no | no | yes |
| 50 | 15.0 | 0.5 | 6.6 | 200 | no | no | no |
| 51 | 15.0 | 0.5 | 8.9 | 200 | no | no | no |
| 52 | 15.0 | 2.0 | 4.4 | 30 | no | no | no |
| 53 | 15.0 | 2.0 | 6.8 | 30 | no | no | no |
| 54 | 15.0 | 2.0 | 5.3 | 100 | no | no | no |
| 55 | 15.0 | 2.0 | 7.7 | 100 | no | no | no |

TABLE 3-continued

| | Wet paper web transfer belt properties | | | | Evaluation condition | Evaluation item (evaluation result) | |
|---|---|---|---|---|---|---|---|
| | Swelling | Roughness of the wet paper web contacting surface | | Basis weight | "Paper | | "Paper robbing" by |
| Example | rate Y (%) | Sheet edge regions Ra1 (μm) | Center region Ra2 (μm) | of the paper ($g/m^2$) | robbing" by the felt | "Floating edges" | the wet paper web transfer belt |
| 56 | 15.0 | 2.0 | 6.6 | 200 | no | no | no |
| 57 | 15.0 | 2.0 | 8.9 | 200 | no | no | no |
| 58 | 15.0 | 3.5 | 4.4 | 30 | no | no | no |
| 59 | 15.0 | 3.5 | 6.8 | 30 | no | no | no |
| 60 | 15.0 | 3.5 | 5.3 | 100 | no | no | no |
| 61 | 15.0 | 3.5 | 7.7 | 100 | no | no | no |
| 62 | 15.0 | 3.5 | 6.6 | 200 | no | no | no |
| 63 | 15.0 | 3.5 | 8.9 | 200 | no | no | no |

TABLE 4

| | Wet paper web transfer belt properties | | | | Evaluation condition | Evaluation item (evaluation result) | |
|---|---|---|---|---|---|---|---|
| | Swelling | Roughness of the wet paper web contacting surface | | Basis weight | "Paper | | "Paper robbing" by |
| Compar. Example | rate Y (%) | Sheet edge regions Ra1 (μm) | Center region Ra2 (μm) | of the paper ($g/m^2$) | robbing" by the felt | "Floating edges" | the wet paper web transfer belt |
| 1 | 1.5 | 2.0 | 4.8 | 30 | yes | — | — |
| 2 | 1.5 | 3.5 | 3.5 | 30 | no | yes | sometimes |
| 3 | 1.5 | 2.0 | 5.7 | 100 | yes | — | — |
| 4 | 1.5 | 4.4 | 4.4 | 100 | no | yes | sometimes |
| 5 | 1.5 | 2.0 | 6.9 | 200 | yes | — | — |
| 6 | 1.5 | 5.6 | 5.6 | 200 | no | yes | sometimes |
| 7 | 5.0 | 2.0 | 6.3 | 30 | yes | — | — |
| 8 | 5.0 | 5.0 | 5.0 | 30 | no | yes | sometimes |
| 9 | 5.0 | 2.0 | 7.1 | 100 | yes | — | — |
| 10 | 5.0 | 5.8 | 5.8 | 100 | no | yes | sometimes |
| 11 | 5.0 | 2.0 | 8.4 | 200 | yes | — | — |
| 12 | 5.0 | 7.1 | 7.1 | 200 | no | yes | sometimes |
| 13 | 15.0 | 2.0 | 7.3 | 30 | yes | — | — |
| 14 | 15.0 | 6.0 | 6.0 | 30 | no | yes | sometimes |
| 15 | 15.0 | 2.0 | 8.2 | 100 | yes | — | — |
| 16 | 15.0 | 6.9 | 6.9 | 100 | no | yes | sometimes |
| 17 | 15.0 | 2.0 | 9.4 | 200 | yes | — | — |
| 18 | 15.0 | 8.1 | 8.1 | 200 | no | yes | sometimes |

As shown in Tables 2 to 4, with the wet paper web transfer belts of Examples 1 to 63, the "floating edges" phenomenon did not occur and the "paper robbing" by the felt 6 was prevented. Furthermore, with the wet paper web transfer belts of Examples 2, 3, 5, 6, 8 to 21, 23, 24, 26, 27, 29 to 42, 44, 45, 47, 48, 50 to 63, which fulfilled the relations of equations (1) and (3), the move of the wet paper web from the wet paper web transfer belt to the dryer fabric was also smooth.

Further, with respect to the wet paper web transfer belts with which there was "paper robbing" by the wet paper web transfer belt, it is possible to solve the problem of "paper robbing" due to the wet paper web transfer belt by increasing the suction force of the suction roll. However, this will apply an excessive load onto the wet paper web, Therefore, it was found that the wet paper web transfer belts of the Examples, which also fulfill the relations of equations (1) and (3), had excellent wet paper web transfer properties without applying an excessive load onto the wet paper web. Moreover, from the above-mentioned results of the Examples, it was possible to confirm that the wet paper web transfer belts according to the instant application have good wet paper web transfer properties corresponding to wet paper webs of base paper with different basis weight.

On the other hand, for the wet paper web transfer belts of the Comparative Examples 1 to 18, it was confirmed that the wet paper web transfer properties were poor as a result of the "floating edges" phenomenon and the "paper robbing" by the felt.

The invention claimed is:

1. A papermaking system comprising:

a press part for squeezing water from a wet paper web, wherein the press part is configured to pass the wet paper web in a closed draw in at least one part thereof by using a wet paper web transfer belt, the wet paper web transfer belt including a wet paper web contacting surface for carrying the wet paper web, said wet paper web contacting surface being made of a water-impermeable resin layer, wherein the wet paper web contacting surface includes, in a width direction, sheet edge regions for carrying edge parts of the wet paper web and a center region for carrying a center vicinity of the wet paper web, wherein an arithmetic average roughness $Ra_1$ (μm) of the wet paper web contacting surface in the sheet edge regions is smaller than an arithmetic average roughness $Ra_2$ (μm) of the wet paper web contacting surface in the center region, and wherein relations of equations (1) and (2) are fulfilled, where $$Ra_2(\mu m)=0.0125\times X+A \quad (1), \text{ and}$$

$$A\leq B\times 10^{-16}\times Y^4+C\times 10^{-4}\times Y^3+D\times 10^{-2}\times Y^2+E\times Y+F \quad (2), \text{ and}$$

where:

X=basis weight (g/m$^2$) of a base paper to be produced from the wet paper web to be transferred, Y=swelling rate (%) of a resin constituting the resin layer with water,

B=4.441,

C=9.132,

D=−4.247,

E=0.6580, and

F=3.1027, respectively.

2. The papermaking system according to claim 1, wherein the press part is configured so that the wet paper web is moved in a closed draw from a felt to the wet paper web transfer belt in at least one part thereof.

3. The papermaking system according to claim 2, wherein the contacting surface of the felt with the wet paper web includes batt fibers, and wherein the batt fibers fulfill the relation of equation (5), where $$0.15X\leq Z\leq 0.3X \quad (5), \text{ and}$$

where:

X=basis weight (g/m$^2$) of the base paper to be produced from the wet paper web to be transferred, and Z=fineness of the batt fibers (dtex), respectively.

4. A papermaking method comprising:

a step for squeezing water from a wet paper web formed by dewatering a pulp slurry, wherein in said step for squeezing water, the wet paper web is passed in a closed draw by using a wet paper web transfer belt, the wet paper web transfer belt including a wet paper web contacting surface for carrying the wet paper web, said wet paper web contacting surface being made of a water-impermeable resin layer, wherein the wet paper web contacting surface includes, in a width direction, sheet edge regions for carrying edge parts of the wet paper web and a center region for carrying a center vicinity of the wet paper web, wherein an arithmetic average roughness $Ra_1$ (μm) of the wet paper web contacting surface in the sheet edge regions is smaller than an arithmetic average roughness $Ra_2$ (μm) of the wet paper web contacting surface in the center region, and wherein relations of equations (1) and (2) are fulfilled, where $$Ra_2(\mu m)=0.0125\times X+A \quad (1), \text{ and}$$

$$A\leq B\times 10^{-16}\times Y^4+C\times 10^{-4}\times Y^3+D\times 10^{-2}\times Y^2+E\times Y+F \quad (2), \text{ and}$$

where:

X=basis weight (g/m$^2$) of a base paper to be produced from the wet paper web to be transferred, Y=swelling rate (%) of a resin constituting the resin layer with water,

B=4.441,

C=9.132,

D=−4.247,

E=0.6580, and

F=3.1027, respectively.

5. The papermaking method according to claim 4, wherein in the step for squeezing water, the wet paper web is configured to move in a closed draw from a felt to the wet paper web transfer belt.

6. The papermaking method according to claim 5, wherein a contacting surface of the felt with the wet paper web includes batt fibers, and wherein the batt fibers fulfill a relation of equation (5) , where $$0.15X\leq Z\leq 0.3X \quad (5), \text{ and}$$

where:

X=basis weight (g/m$^2$) of the base paper to be produced from the wet paper web to be transferred, and Z=fineness of the batt fibers (dtex), respectively.

7. The papermaking method according to claim 5, wherein the felt comprises a wet paper web contacting surface for carrying the wet paper web, said wet paper web contacting surface including, in the width direction, sheet edge regions for carrying the edge parts of the wet paper web and a center region for carrying the center vicinity of the wet paper web, and wherein the arithmetic average roughness of the wet paper web contacting surface in the sheet edge regions is smaller than the arithmetic average roughness of the wet paper web contacting surface in the center region.

8. A method of producing a wet paper web transfer belt, comprising the steps of:

installing a reinforcing fibrous substrate as to be in contact with two rolls arranged in parallel;

applying a resin material to form a resin layer on an outer surface of the reinforcing fibrous substrate by discharging the resin material from a resin discharge opening while the rolls rotate;

curing the resin layer coated on the reinforcing fibrous substrate;

polishing an outer surface of the resin layer, the outer surface being configured to contact a wet paper web and to carry the wet paper web, wherein the outer surface includes, in a width direction, sheet edge regions for carrying edge parts of the wet paper web and a center region for carrying a center vicinity of the wet paper web, wherein an arithmetic average roughness $Ra_1$ (μm) of the outer surface in the sheet edge regions is smaller than an arithmetic average roughness $Ra_2$ (μm) of the outer surface in the center region, and wherein relations of equations (1) and (2) are fulfilled, where $$Ra_2(\mu m)=0.0125\times X+A \quad (1), \text{ and}$$

$$A\leq B\times 10^{-16}\times Y^4+C\times 10^{-4}\times Y^3+D\times 10^{-2}\times Y^2+E\times Y+F \quad (2), \text{ and}$$

where:

X=basis weight (g/m$^2$) of a base paper to be produced from the wet paper web to be transferred, Y=swelling rate (%) of a resin constituting the resin layer with water,

B=4.441,

C=9.132,

D=−4.247,

E=0.6580, and

F=3.1027, respectively.

9. The method of producing a wet paper web transfer belt according to claim 8, wherein $Ra_1$ (μm) is 3.5 μm or less.

10. The method of producing a wet paper web transfer belt according to claim 8, wherein relations of equations (1) and (3) are fulfilled, where $$Ra_2(\mu m)=0.0125\times X+A \quad (1), \text{ and}$$

$$B\times 10^{-16}\times Y^4+C\times 10^{-4}\times Y^3+D\times 10^{-2}\times Y^2+E\times Y+G\leq A \quad (3), \text{ and}$$

where:

X=basis weight (g/m$^2$) of the base paper to be produced from the wet paper web to be transferred, Y=swelling rate (%) of the resin constituting the resin layer with water,

B=4.441,

C=9.132,

D=−4.247,

E=0.6580, and

G=0.6027, respectively.

11. The method of producing a wet paper web transfer belt according to claim 8, wherein a relation of equation (4) is fulfilled, where $$(Ra_2-Ra_1)\geq 0.3(\mu m) \quad (4).$$

12. The method of producing a wet paper web transfer belt according to claim 8, wherein $Ra_1$ and $Ra_2$ represent the roughness of a new wet paper web transfer belt before the new wet paper web transfer belt has been installed in a papermaking machine.

13. The method of producing a wet paper web transfer belt according to claim 8, wherein $Ra_1$ and $Ra_2$ represent the roughness of a used wet paper web transfer belt after the used wet paper web transfer belt has been installed in a papermaking machine.

14. The method of producing a wet paper web transfer belt according to claim 8, wherein Y is in the range of 1.5-15%.

* * * * *